US012735852B1

(12) United States Patent
Lamore

(10) Patent No.: US 12,735,852 B1
(45) **Date of Patent: *Sep. 15, 2026**

(54) SHALLOW-MOUNT, STAND-ALONE SECURITY BOLLARD

(71) Applicant: Barrier1 Systems, LLC, Greensboro, NC (US)

(72) Inventor: Michael John Lamore, Greensboro, NC (US)

(73) Assignee: Barrier1 Systems, LLC, Greensboro, NC (US)

( * ) Notice: Subject to any disclaimer, the term of this patent is extended or adjusted under 35 U.S.C. 154(b) by 148 days.

This patent is subject to a terminal disclaimer.

(21) Appl. No.: 17/524,309

(22) Filed: Nov. 11, 2021

Related U.S. Application Data

(63) Continuation of application No. 16/407,277, filed on May 9, 2019, now Pat. No. 11,174,606.

(60) Provisional application No. 62/738,579, filed on Sep. 28, 2018.

(51) Int. Cl.
*E01F 15/00* (2006.01)

(52) U.S. Cl.
CPC ..... *E01F 15/003* (2013.01)

(58) Field of Classification Search
CPC ..... E01F 15/003; E01F 15/00
See application file for complete search history.

(56) References Cited

U.S. PATENT DOCUMENTS 637,697 A * 11/1899 Bartlett ..... B65D 85/52 229/173
878,418 A * 2/1908 Olin ..... A63H 33/22 446/485
1,241,041 A 9/1917 Slick
1,272,349 A * 7/1918 Abrahams ..... A47F 5/112 211/72
1,412,846 A * 4/1922 Dietsche, Jr. ..... A47F 3/145 40/539
1,449,518 A 3/1923 Guard
1,677,038 A 7/1928 Lookabaugh
1,795,247 A 3/1931 Burns
1,913,715 A 6/1933 Macdonald
2,646,969 A 7/1953 Hendrickson
2,907,552 A 10/1959 Crone
(Continued)

FOREIGN PATENT DOCUMENTS

CA 2852178 A1 5/2013
DE 3036227 A1 10/1982
(Continued)

OTHER PUBLICATIONS

Hogue, L.E., U.S. Pat. No. 158,941 for "Farm-Fences" patented on Jan. 19, 1875, pp. 1-2.
(Continued)

*Primary Examiner* — Christopher J Sebesta
*Assistant Examiner* — Katherine J Chu
(74) *Attorney, Agent, or Firm* — Additon, Pendleton & Witherspoon, P.A.

(57) ABSTRACT

A shallow-mount, stand-alone security bollard includes a bollard post mounted to a base. The bollard post extends upwardly from within an interior space of the base. The base includes interconnected panels, including panels extending around the interior space of the base, and inner panels connected to the bollard post and dividing the interior space.

18 Claims, 18 Drawing Sheets

(56) References Cited

U.S. PATENT DOCUMENTS

| | | | | |
|---|---|---|---|---|
| 3,614,142 | A * | 10/1971 | Muller | E02D 27/16 405/250 |
| 3,915,434 | A | 10/1975 | Lister | |
| 4,236,740 | A * | 12/1980 | Sorenson | B65D 5/22 229/160 |
| 5,228,237 | A | 7/1993 | Nasatka | |
| 5,406,663 | A | 4/1995 | Chen | |
| 5,779,227 | A | 7/1998 | Elkins et al. | |
| 5,836,715 | A | 11/1998 | Hendrix et al. | |
| 5,956,916 | A | 9/1999 | Liss | |
| 6,176,062 | B1 | 1/2001 | Fayle | |
| 6,257,557 | B1 | 7/2001 | Anderson et al. | |
| 6,347,489 | B1 * | 2/2002 | Marshall, Jr. | E02D 27/00 52/126.6 |
| 6,409,419 | B1 | 6/2002 | Hernandez | |
| 6,948,283 | B2 | 9/2005 | Burkart et al. | |
| 7,101,111 | B2 * | 9/2006 | Albritton | E01F 15/0423 404/6 |
| 7,118,304 | B2 | 10/2006 | Turpin et al. | |
| 7,278,240 | B2 | 10/2007 | Burkart et al. | |
| 7,441,751 | B1 * | 10/2008 | Gibbs | E04H 17/143 256/34 |
| 7,524,135 | B1 * | 4/2009 | Mirman | E01F 13/065 40/607.05 |
| 7,549,259 | B2 | 6/2009 | Calle | |
| 7,607,856 | B2 | 10/2009 | Patel | |
| 7,699,558 | B2 | 4/2010 | Alder et al. | |
| 7,775,738 | B2 | 8/2010 | Darcy | |
| 8,146,322 | B2 | 4/2012 | Karns | |
| 8,197,156 | B2 * | 6/2012 | Morgan | E01F 13/12 404/9 |
| 8,215,865 | B2 | 7/2012 | Adler et al. | |
| 8,226,322 | B2 | 7/2012 | Blair | |
| 8,439,594 | B1 * | 5/2013 | Clark | E01F 13/123 404/9 |
| 8,820,722 | B2 * | 9/2014 | Reinert, Sr. | E04H 17/17 256/65.14 |
| 8,979,419 | B2 | 3/2015 | Heald | |
| 9,315,956 | B2 | 4/2016 | Heald | |
| 9,506,239 | B2 | 11/2016 | Houghton | |
| 10,119,230 | B2 | 11/2018 | Heald | |
| 10,180,011 | B2 * | 1/2019 | White | E04H 12/2261 |
| 10,501,957 | B1 | 12/2019 | Borowiak | |
| D891,643 | S * | 7/2020 | Tosolini | D25/58 |
| 10,753,055 | B2 * | 8/2020 | Tosolini | E01F 13/12 |
| 10,988,903 | B1 | 4/2021 | Neuseh | |
| 11,060,254 | B2 * | 7/2021 | Kirn | E01F 13/026 |
| 11,174,606 | B1 * | 11/2021 | Lamore | E01F 13/026 |
| 11,499,279 | B1 | 11/2022 | Lamore | |
| 11,781,276 | B1 | 10/2023 | Lamore | |
| 2004/0262588 | A1 | 12/2004 | Bronstad | |
| 2007/0034847 | A1 * | 2/2007 | Shertzer | E04H 17/22 256/65.14 |
| 2007/0176159 | A1 * | 8/2007 | Schram | E01F 13/026 256/65.14 |
| 2008/0067484 | A1 | 3/2008 | Amengual Pericas | |
| 2008/0075530 | A1 * | 3/2008 | Siu | E01F 13/024 404/9 |
| 2008/0112756 | A1 * | 5/2008 | Omar | E01F 13/12 404/9 |
| 2008/0296462 | A1 | 12/2008 | Siu | |
| 2009/0028638 | A1 * | 1/2009 | Crawford | E01F 13/12 404/6 |
| 2009/0035061 | A1 * | 2/2009 | Crawford | E01F 9/681 404/6 |
| 2011/0164921 | A1 * | 7/2011 | Morgan | E01F 13/12 404/6 |
| 2016/0053449 | A1 | 2/2016 | Kemper et al. | |
| 2016/0076208 | A1 | 3/2016 | Gerrard et al. | |
| 2016/0130775 | A1 | 5/2016 | Brackin et al. | |
| 2016/0160515 | A1 | 6/2016 | Wallance | |
| 2016/0168840 | A1 | 6/2016 | Monty et al. | |
| 2018/0327995 | A1 | 11/2018 | Earhart et al. | |
| 2018/0371790 | A1 | 12/2018 | Westfahl | |
| 2019/0136470 | A1 | 5/2019 | Dickinson et al. | |
| 2019/0136568 | A1 * | 5/2019 | Karakas | E04B 1/167 |
| 2020/0109529 | A1 | 4/2020 | Kemmish | |
| 2021/0012621 | A1 | 1/2021 | Anderson | |

FOREIGN PATENT DOCUMENTS

| | | | | |
|---|---|---|---|---|
| DE | 3929247 | C1 | 10/1990 | |
| EP | 1070789 | A1 | 1/2001 | |
| GB | 607016 | | 8/1948 | |
| GB | 1480245 | | 7/1977 | |
| GB | 2229472 | A | 9/1990 | |
| KR | 200437211 | Y1 * | 11/2007 | |
| WO | WO-2012101451 | A1 * | 8/2012 | E01F 13/12 |

OTHER PUBLICATIONS

Warner, I. M., U.S. Pat. No. 621,000 for "Fence Post" patented on Mar. 14, 1899, pp. 1-2.

Warner, I. M., U.S. Pat. No. 769,967 for "Fence Post Device" patented on Sep. 13, 1904, pp. 1-3.

Lamore, U.S. Appl. No. 16/787,206 for "Shallow-Mount Braced-Post Barrier" filed Feb. 11, 2020, pp. 1-67.

Lamore, U.S. Appl. No. 17/984,303 for "Shallow-Mount Braced-Post Barrier" filed Nov. 10, 2022, pp. 1-64.

Commonly owned U.S. Appl. No. 18/377,051, filed Oct. 5, 2023, pp. 1-66.

L.E. Hogue, U.S. Pat. No. 158,941, dated Jan. 19, 1875, pp. 1-2.

A. Brady, U.S. Pat. No. 225,683, dated Mar. 23, 1880, pp. 1-2.

* cited by examiner

SHALLOW-MOUNT, STAND-ALONE SECURITY BOLLARD

CROSS-REFERENCE TO PRIORITY APPLICATIONS

This application is a continuation of U.S. patent application Ser. No. 16/407,277 filed May 9, 2019, which claims the benefit of U.S. Provisional Application No. 62/738,579 filed Sep. 28, 2018, and each of the above-referenced application is hereby incorporated by reference in its entirety.

FIELD OF THE INVENTION

The present invention relates to bollards and, more particularly, to shallow-mount security bollards that restrict vehicle access.

BACKGROUND

Bollards are frequently used to protect buildings, personnel, and critical assets against undesirable vehicle impacts, for example vehicle ramming attacks. Such security bollards typically include a steel base set in concrete within a hole in the ground, and an upright steel pipe extending from the base to above ground. For resisting high-energy vehicle impacts, it is typical for the hole, concrete foundation, and base to extend relatively deep into the ground. Alternatively, if the holes, concrete foundations, and bases are relatively shallow, typically the bases of adjacent bollards are fixedly connected to one another by reinforcing steel structures in order to achieve the resistance needed to stop high-energy vehicle impacts.

In some situations it can be difficult and/or inefficient to provide deep holes, deep concrete foundations, and deep bases of bollards. For example, underground rocks, underground utilities, tunnels, basements, subways and/or other underground features may restrict the depth of bollards. Similarly, it can also be difficult and/or inefficient to fixedly connect bases of adjacent shallow mount bollards to one another with reinforcing steel structures, for example due to shallow obstructions between the adjacent bollards such as manholes, electrical vaults, drainage features, meters, low voltage wiring or conduits, and other near-surface obstructions. In some situations, bollard protection against vehicle impact is provided for a small area, such as a pole structure, and there is limited room where only one single stand-alone bollard will fit. Accordingly, there is a desire for a bollard and bollard systems that provide a new balance of properties (e.g., capabilities).

SUMMARY

An aspect of this disclosure is the provision of a bollard assembly that is capable of being advantageously used as a shallow-mount, single stand-alone security bollard. Notwithstanding, the bollard assembly of this disclosure may be used in installations other than shallow-mount and/or stand-alone bollard installations.

In one example, a bollard assembly can include a base and a bollard post mounted to the base and extending upwardly from an interior space within the base. The base can include interconnected panels, including a plurality of panels extending at least partially around the interior space, and an inner panel connected to at least one of the plurality of panels. The inner panel can at least partially divide the interior space. For increased strength, connections between panels extending crosswise to one another can include a portion of one panel mated into a cavity of another panel. At least some of the mated-together portions can also be welded together.

In another example, a base for anchoring a bollard post can include: one or more upright panels; an upper panel extending crosswise to, and connected to, the upright panels; a lower panel extending crosswise to, and connected to, the upright panels; an intermediate panel extending crosswise to, and connected to, the upright panels; and a mount (e.g., upright tube) extending through a hole in the intermediate panel. The intermediate panel can be positioned between, and spaced apart from each of, the upper panel and the lower panel. The tube can be configured for being connected to the bollard post. The tube can have a lower end portion connected to the lower panel, and an upper end portion connected to the upper panel.

As a further example, a base for anchoring a bollard post can include an upright right panel; an upright left panel; an upright intermediate panel positioned between, and spaced apart from each of, the right panel and the left panel; at least one crosswise panel extending crosswise to, and connected to each of, the right panel, the left panel, and the intermediate panel; and a mount (e.g., upright tube) connected to the crosswise panel. The tube can be configured for being connected to the bollard post.

The foregoing summary provides a few brief examples and is not exhaustive, and the present invention is not limited to the foregoing examples. The foregoing examples, as well as other examples, are further explained in the following detailed description with reference to accompanying drawings.

BRIEF DESCRIPTION OF THE DRAWINGS

The drawings are provided as examples. The present invention may be embodied in many different forms and should not be construed as limited to the examples depicted in the drawings.

DETAILED DESCRIPTION

Examples of embodiments are disclosed in the following. The present invention may, however, be embodied in many different forms and should not be construed as limited to the embodiments set forth herein. For example, features disclosed as part of one embodiment or example can be used in the context of another embodiment or example to yield a further embodiment or example. As another example of the breadth of this disclosure, it is within the scope of this disclosure for one or more of the terms "substantially," "about," "approximately," and/or the like, to qualify each of the adjectives and adverbs of the Detailed Description section of disclosure, as discussed in greater detail below.

Figure 1:
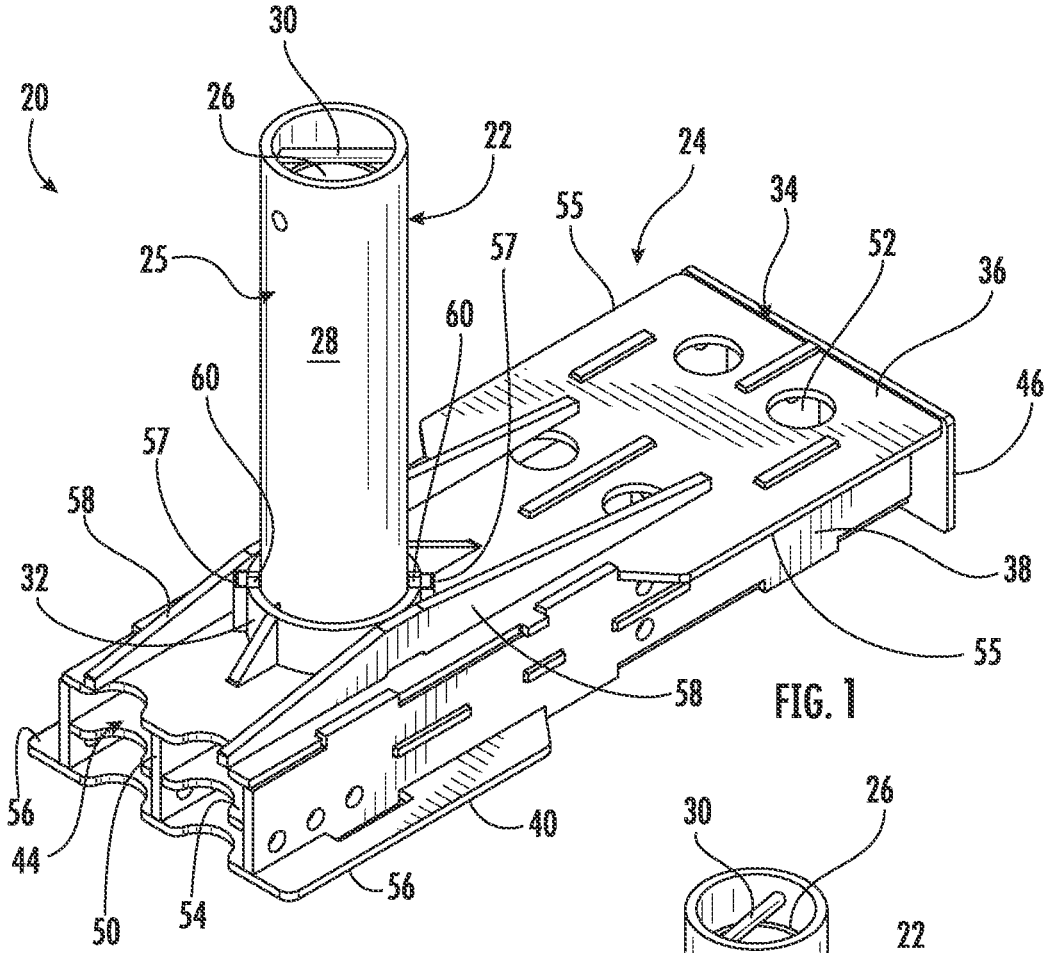
FIG. 1 is a front, top-right perspective view of a bollard assembly in accordance with an embodiment of this disclosure.
Figure 2:
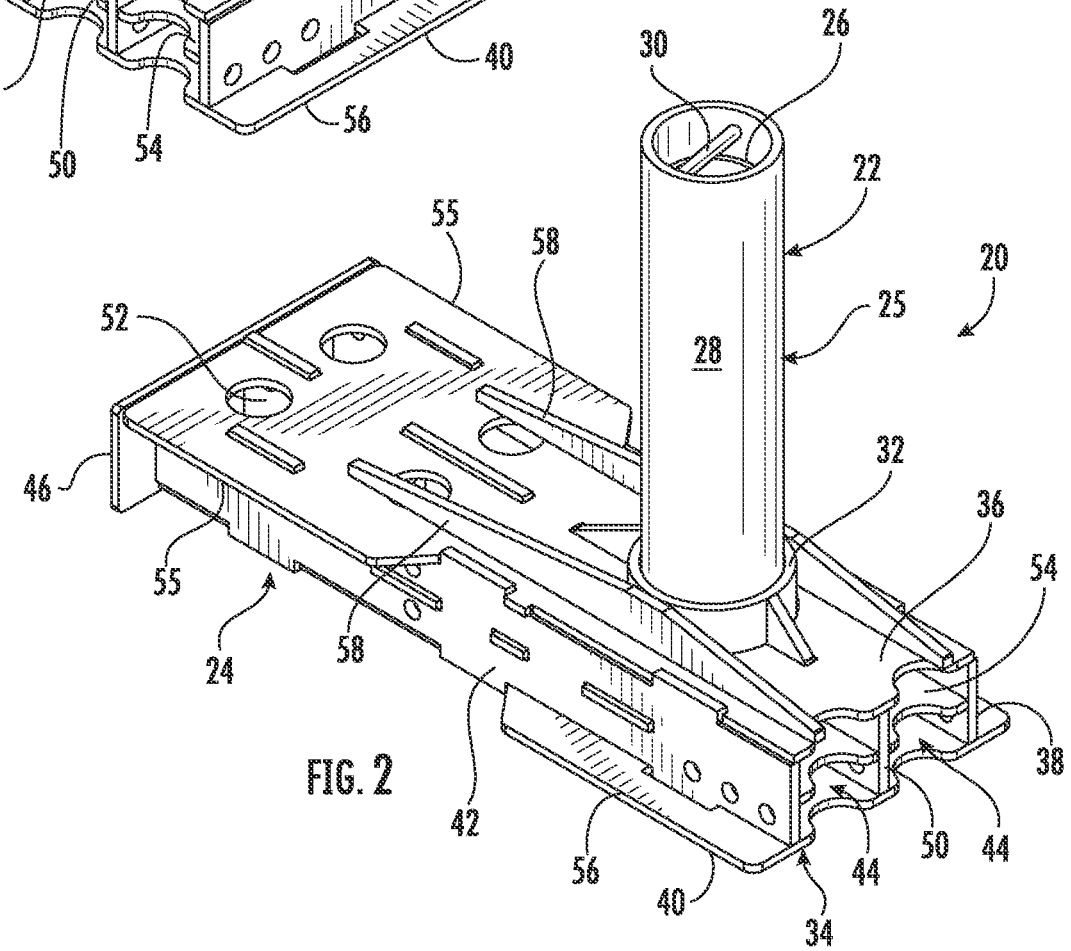
FIG. 2 is a front, top-left perspective view of the bollard assembly of FIG. 1.
Figure 3:
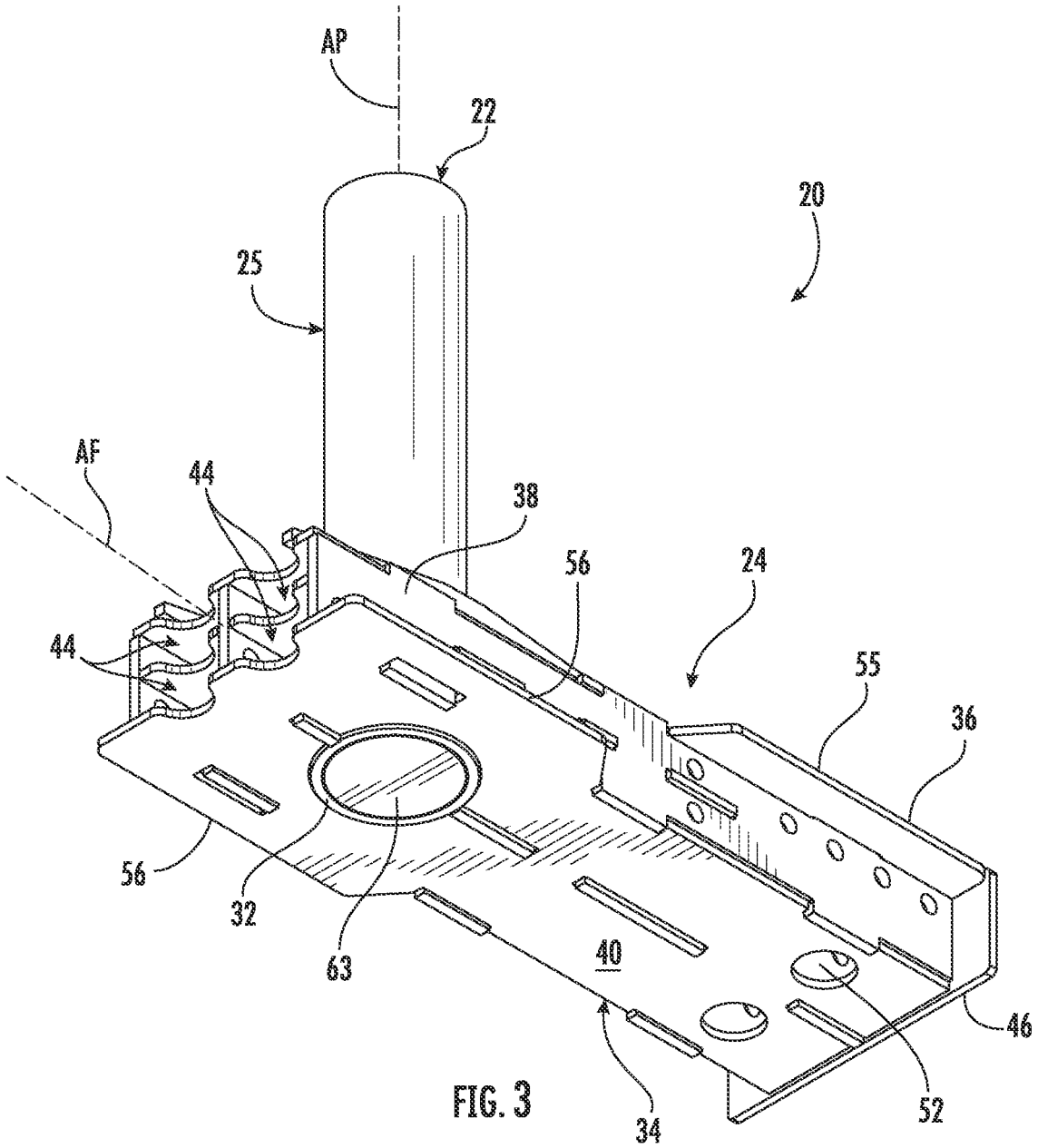
FIG. 3 is a front, bottom-right perspective view of the bollard assembly of FIG. 1.

FIGS. 1-3 depict that a bollard assembly 20 of an embodiment of this disclosure includes a bollard post 22 mounted to and extending upwardly from a base 24. As will be discussed in greater detail below, the base 24 can be embedded in a firm substrate (e.g., concrete foundation) so that the bollard post 22 extends upwardly above the embedding substrate to block vehicles from passing through the area obstructed by the bollard post. In one example of a method of operation of the bollard assembly 20, the bollard assembly can be configured to arrest movement of a heavy vehicle (e.g., a truck) that is moving at a high speed and impacts the front 25 of the bollard post 22. The bollard assembly 20 can also block a variety of different types of vehicles traveling in different directions.

The bollard post 22 can include one or more tubes, for example concentric inner and outer tubes 26, 28 (e.g., steel pipes) fixedly connected to one another by an interference fit and/or other suitable connections (e.g., weld(s)). A crosswise lifting mechanism or pin 30 for use in lifting the bollard assembly 20 or bollard post 22 can be fixedly connected to, and span the diameter of, at least the outer tube 28.

In the embodiment depicted in the drawings, the base 24 includes at least one mount comprising a receptacle tube 32 (e.g., steel pipe) fixedly mounted to a body that can be in the form of a frame 34, wherein the mount or receptacle tube is configured to releasably receive the lower end portion of the bollard post 22. Alternatively, the receptacle tube 32 may be omitted or configured differently. For example, rather than having the receptacle tube 32 positioned between the frame 34 and the lower end portion of the bollard post 22, the lower end portion of the bollard post can be mounted to the frame 34 in another suitable manner, for example by welding the lower end portion of the bollard post directly to respective portions of the frame 34.

In the depicted embodiment, the frame 34 includes one or more outer panels, for example a horizontal upper panel 36, a vertical right panel 38, a lower horizontal panel 40, and a left vertical panel 42 that are respectively connected (e.g., welded) to one another and collectively extend around (e.g., at least partially around) a frame interior space 44 extending between front and rear portions of the frame 34. The frame 34 can further include a vertical, outer rear panel 46 connected (e.g., welded) to rear ends of one or more of the outer panels 36, 38, 40, 42 and obstructing the rear end of the frame interior space 44. In the depicted embodiment, the frame 34 further includes one or more inner panels that at least partially divide the frame interior space 44. The inner panels of the frame 34 can include forward and rearward intermediate panels 50, 52 that extend vertically, and an intermediate panel 54 that extends horizontally.

In at least some configurations, it is believed to be unnecessary for the respective panels to extend exactly vertically and horizontally. More generally, the frame can include panels extending transversely or crosswise to one another (e.g., neither exactly perpendicular nor meeting at exactly right angles). Accordingly and for example, the forward and rearward intermediate panels 50, 52 can be referred to as extending upright, and the intermediate panel 54 can be referred to as extending crosswise to the forward and rearward upright-intermediate panels 50, 52.

The bollard assembly 20 can be configured as, and used as, a stand-alone security bollard, for example a single stand-alone security bollard capable of stopping a 15,000 pound vehicle traveling at fifty miles per hour in accordance with ASTM F2656-07 M50 (K12). As another example, the bollard assembly 20 can be configured as, and used as, a stand-alone security bollard, for example a single stand-alone security bollard capable of stopping at least a 5,000 pound vehicle traveling at twenty-five miles per hour.

Figure 22:
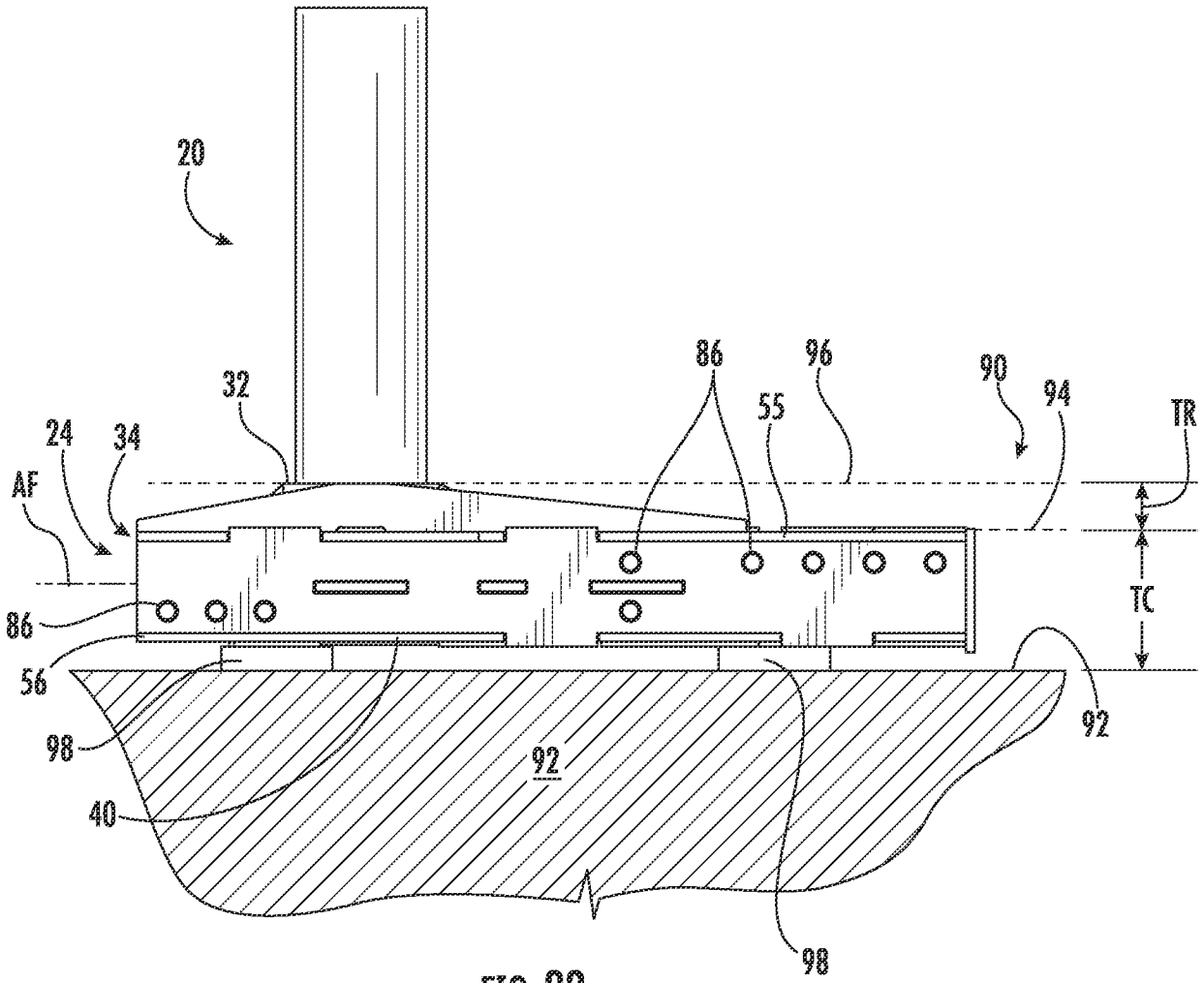
FIG. 22 is a schematic, right elevation view of the bollard assembly of FIG. 21 with its base embedded in a foundation (e.g., concrete) supported by a subgrade, in accordance with an embodiment of this disclosure.
Figure 23:
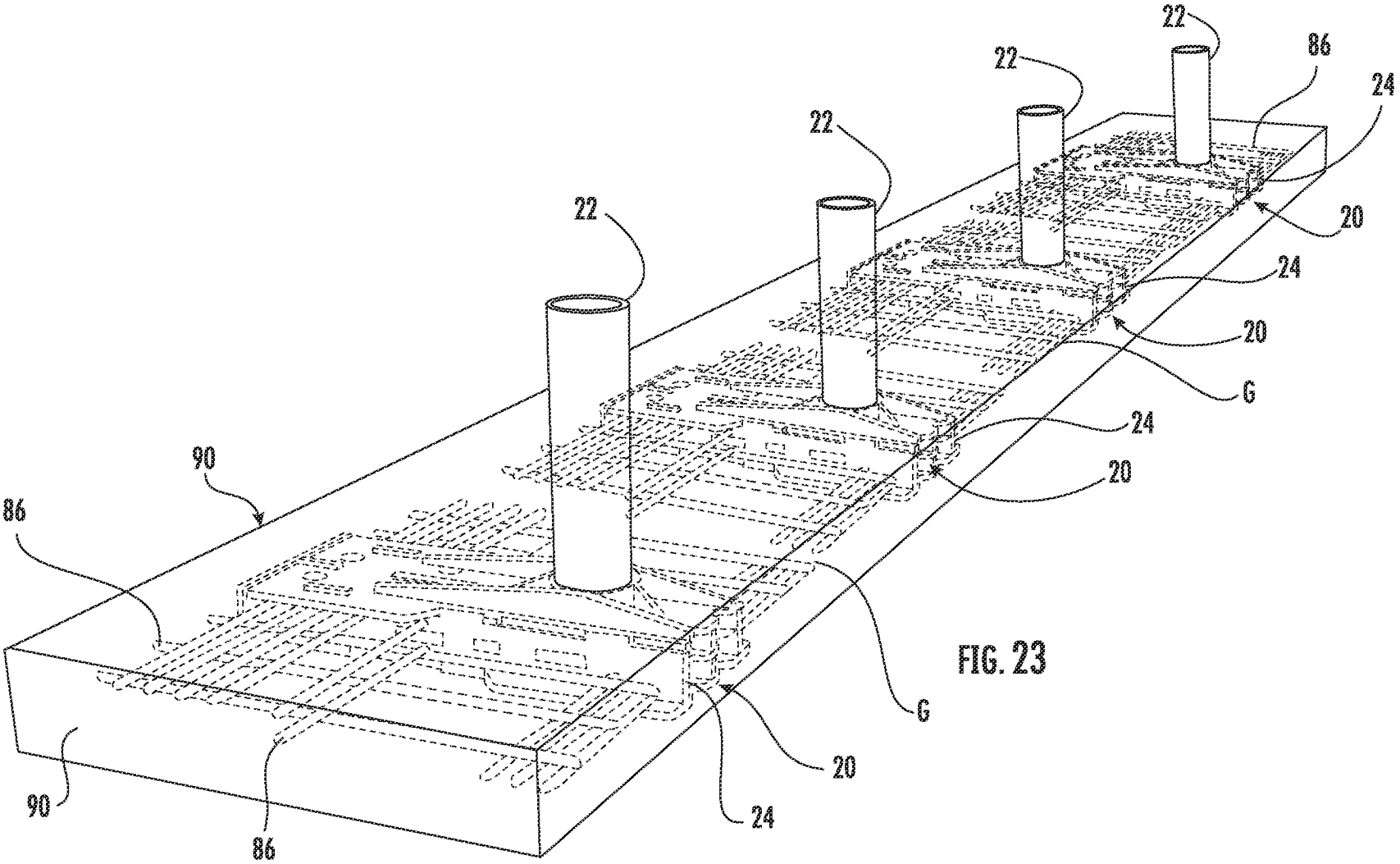
FIG. 23 is a schematic, front, top-left perspective view of an example of a series of the bollard assemblies of FIG. 22 arranged in a straight row, wherein the bases of the bollard assemblies are embedded in a foundation, in accordance with an embodiment of this disclosure.
Figure 24:
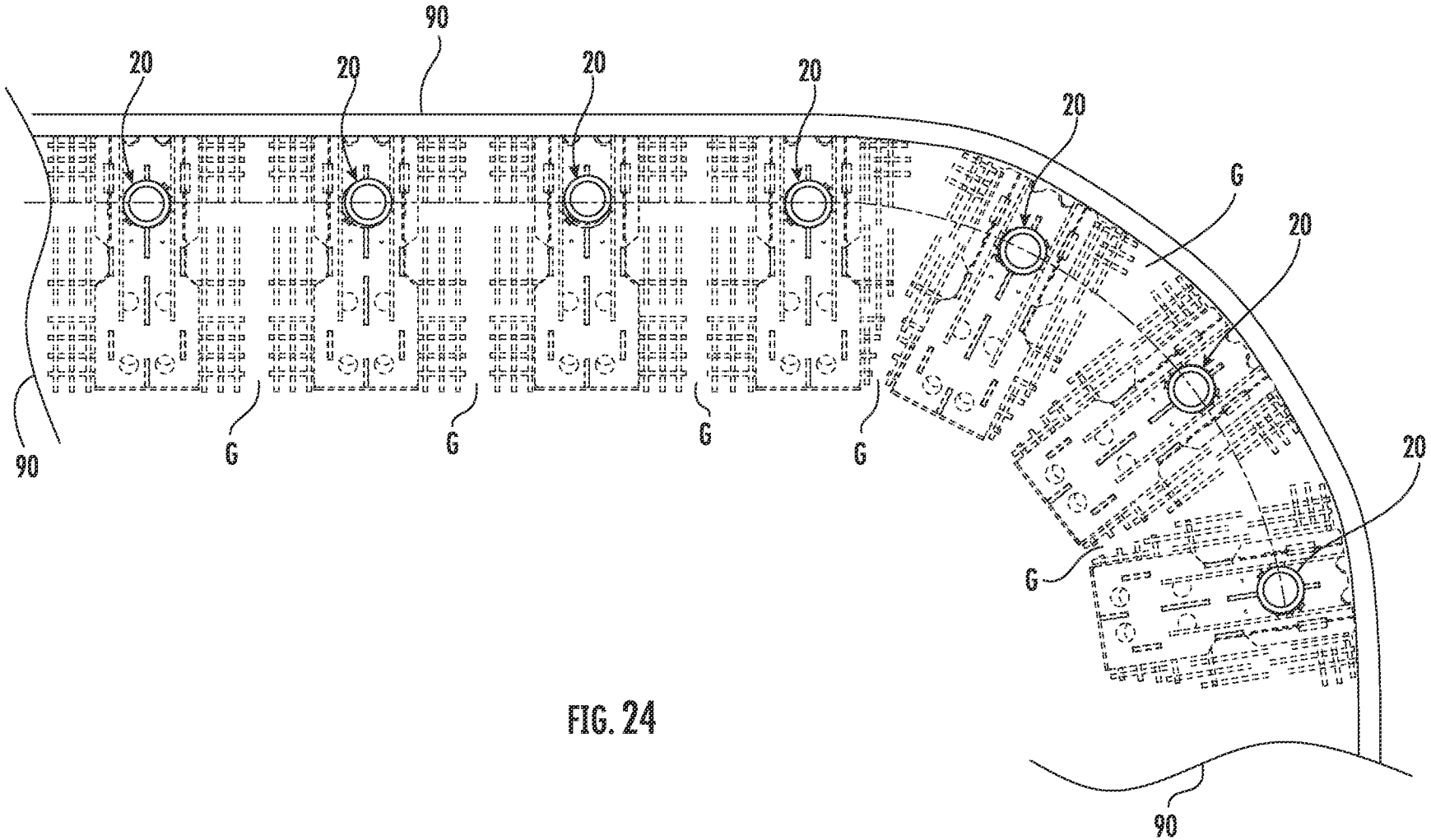
FIG. 24 is a schematic, top plan view of an example of a series of the bollard assemblies of FIG. 22 arranged in a straight row that transitions to a curved row, wherein the bases of the bollard assemblies are embedded in a foundation, in accordance with an embodiment of this disclosure.

For example, the base 24 can be configured in a manner that seeks to ensure that the base is securely anchored within an embedding substrate 90 (FIGS. 22-24). As one specific example and with continued reference to FIGS. 1-3, the upper and lower panels 36, 40 can have widths that are tapered along the length of the frame 34 in a manner that seeks to ensure that the base is securely anchored within the embedding substrate 90, and to resist rotation of the base within the embedding substrate when the front 25 of the bollard post 22 is impacted by a vehicle. For example, the rear portion of the upper panel 36 can be wider than the rear portion of the lower panel 40, and also extend farther outwardly than other portions of the frame 34, so that margins of the rear portion of the upper panel form outwardly extending, horizontal or crosswise-extending upper flanges 55 of the frame 34. Similarly, the front portion of the lower panel 40 can be wider than the front portion of the upper panel upper panel 36 so that margins of the front portion of the lower panel form horizontal or crosswise-extending lower flanges 56 of the frame 34.

With continued reference to FIG. 1 and as will be discussed in greater detail below, the base 24 can include additional performance-enhancing features. For example, upper channel pieces 57 and triangular upper gusset panels 58 can be connected (e.g., welded) to both the outer surface of the receptacle tube 32 and the upper surface of the upper panel 36. Referring to FIG. 1, the upper channel pieces 57 laterally cover upper portions of upwardly open L-shaped mounting slots 60 that are defined in the receptacle tube 32 and configured for use in releasably mounting the bollard post 22 to the base 24, as will be discussed in greater detail below.

Referring to FIG. 3, when the bollard post 22 is to be removable from the base 24 after installation of the bollard assembly, the lower end of the receptacle tube 32 is typically closed by a lower cap 63 (e.g., base plate) fixedly mounted (e.g., welded) to the lower end of the receptacle tube. Alternatively, in versions in which the bollard post 22 is not removable from the base 24, the lower cap 63 may be omitted.

In FIG. 3, axes are schematically depicted with dashed lines. A lengthwise axis of the frame 34 is designated by "AF" in FIG. 3 and extends through frame interior space 44. A lengthwise axis of the bollard post is designated by "AP" in FIG. 3 and extends crosswise to, or more specifically perpendicularly to, the frame axis AF. In the depicted embodiment, the upright and crosswise intermediate panels 50, 52, 54 at least partially divide the frame interior space 44 into more than one (e.g., at least four) interior subspaces that each extend along the frame axis AF. The frame's upper and lower flanges 55, 56 can extend along, and be positioned on opposite upper and lower sides of, the frame axis AF, as discussed in greater detail below.

In the depicted embodiment, each of the flanges 55, 56 extend along the length of the base's body (e.g., frame 34) and have a length shorter than the length of the base's body or frame. The lengths of the flanges 55, 56 can be about half the length of the base's body or frame 34, or less than about half the length of the base's body or frame, or less than half the length of the base's body or frame.

Figure 4:
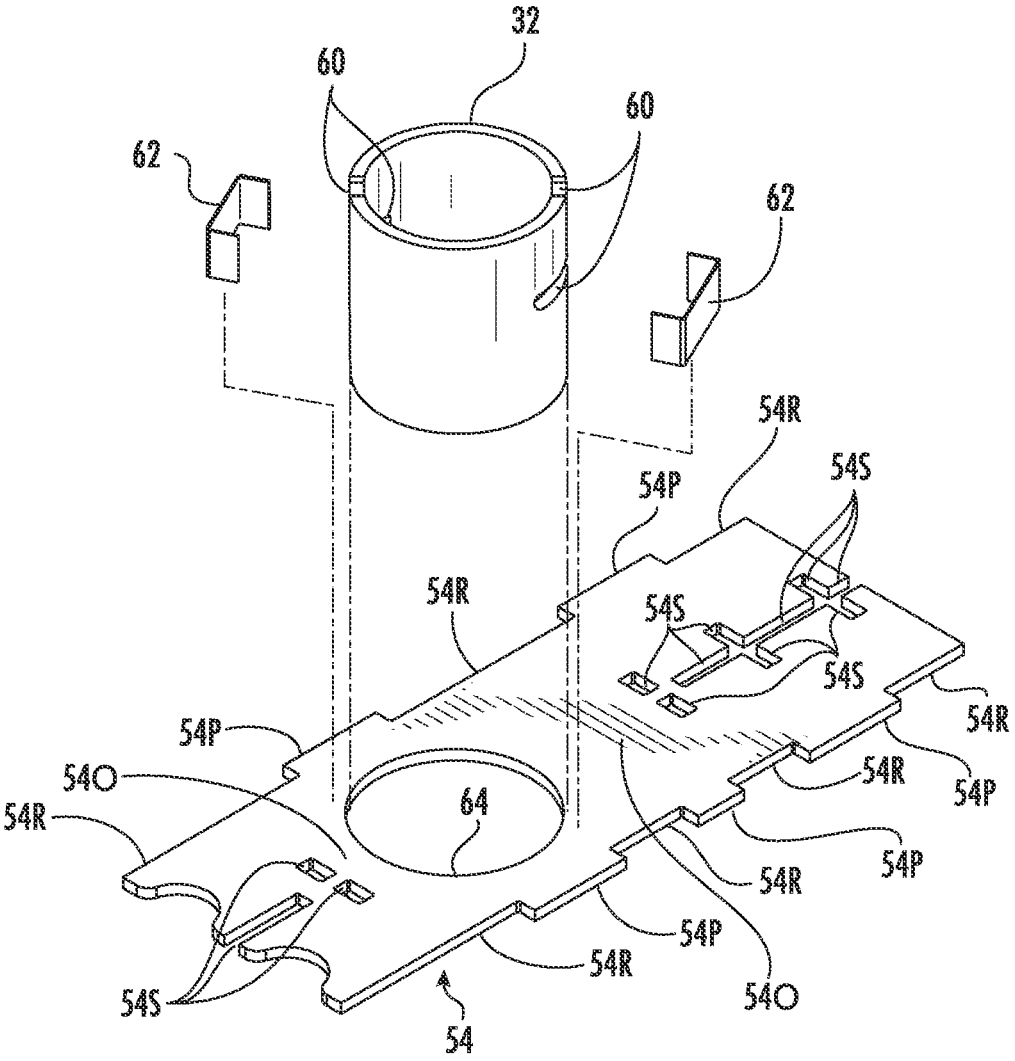
FIG. 4 is a front, top-right, exploded perspective view of selected components of a base of the bollard assembly of FIG. 1.

FIG. 4 is an exploded view of the receptacle tube 32, crosswise-intermediate panel 54, and lower channel pieces 62 of the frame 34. The receptacle tube 32 can extend downwardly and upwardly through a post-receiving hole 64 in the crosswise-intermediate panel 54. In the depicted embodiment, the receptacle tube 32 is inserted through the post-receiving hole 64 and can be connected (e.g., welded) to the crosswise-intermediate panel 54. The lower channel pieces 62 can be connected (e.g., welded) to both the outer surface of the receptacle tube 32 and the upper surface of the crosswise-intermediate panel 54, so that the lower channel pieces 62 cover, without obstructing, the horizontally extending legs of the L-shaped mounting slots 60.

Figure 5:
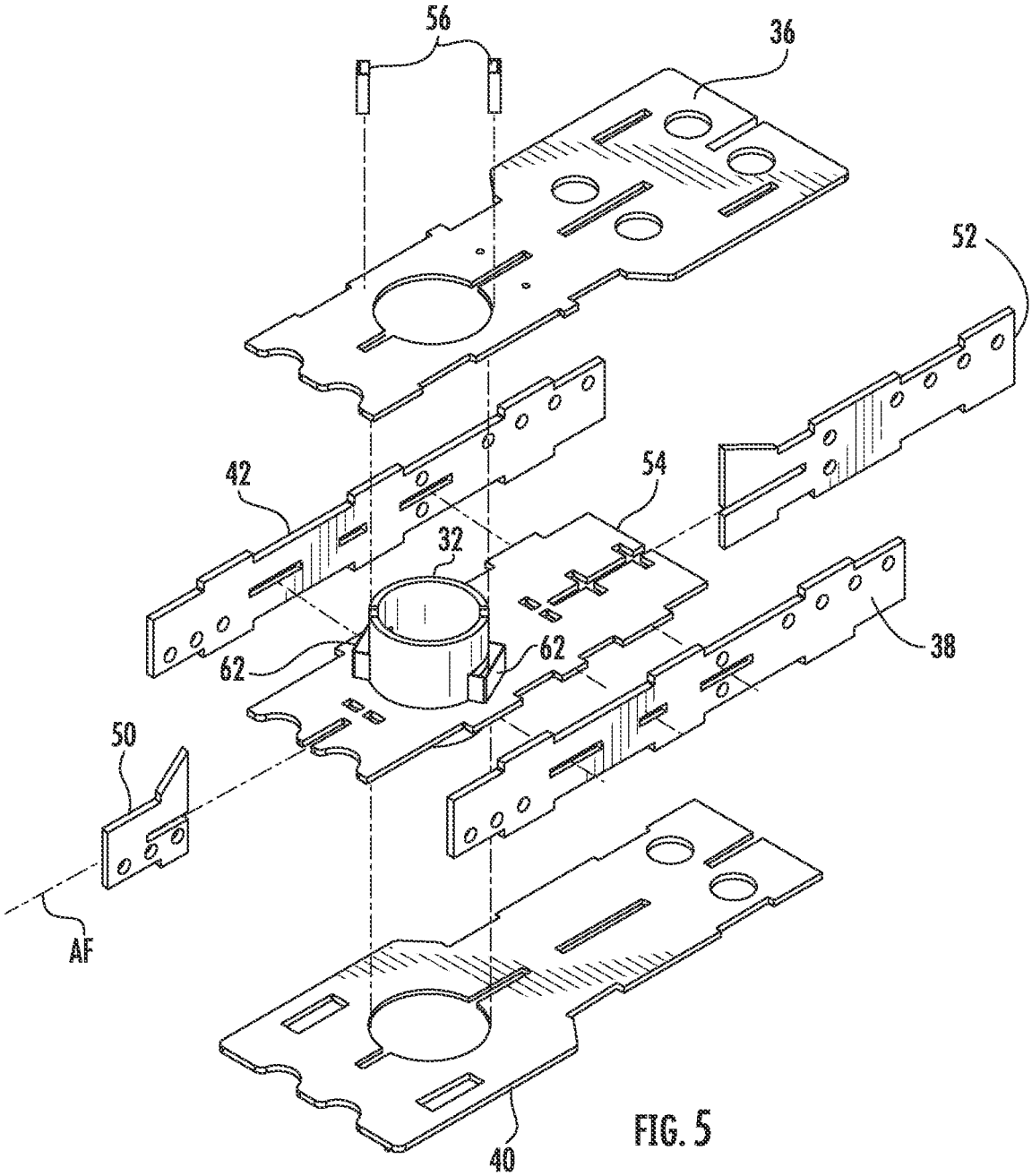
FIG. 5 is a front, top-right, partially exploded perspective view of selected components of the base of FIG. 1, including the components of FIG. 4 in their assembled configuration.
Figure 6:
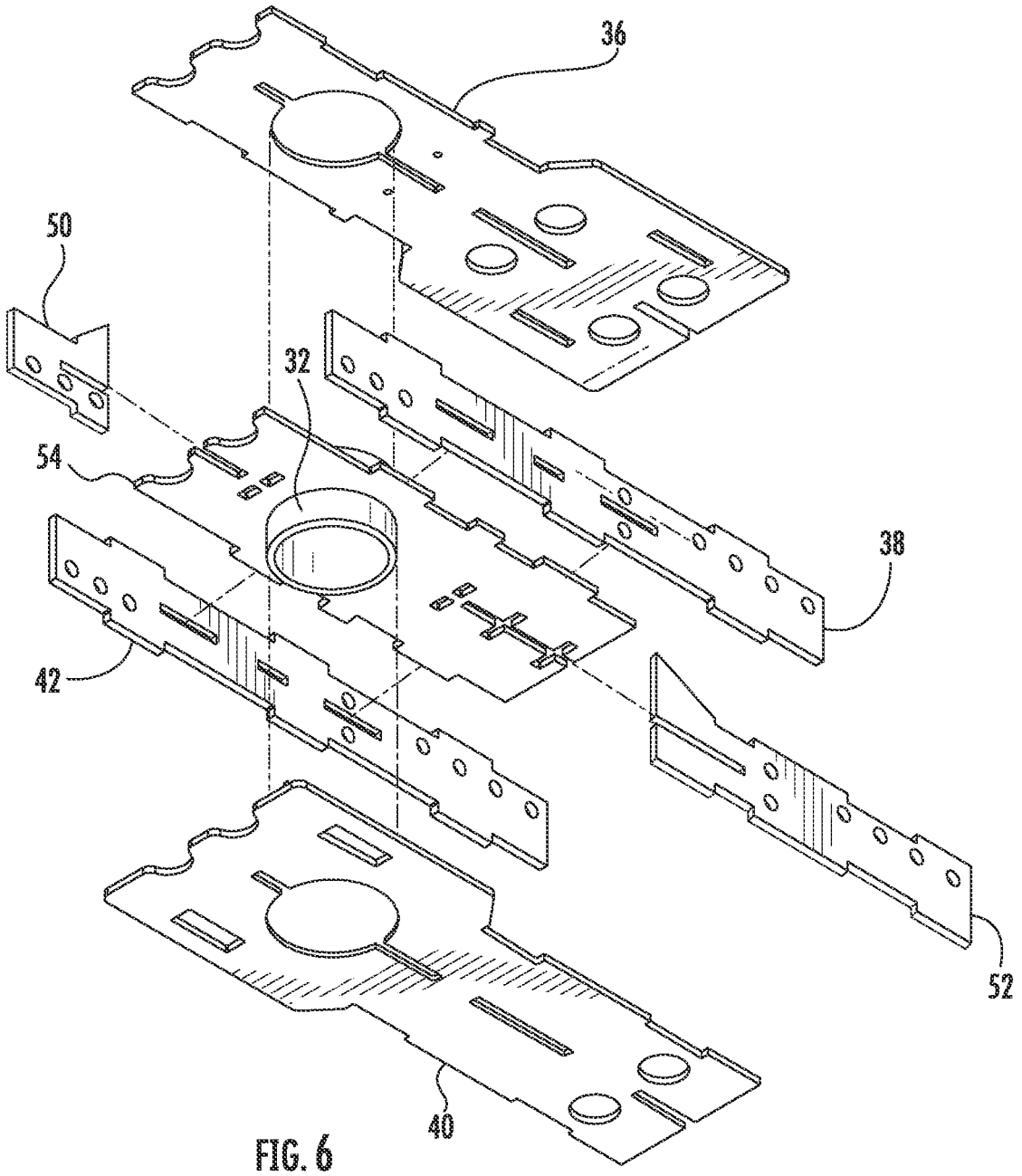
FIG. 6 is a front, bottom-right view substantially corresponding to FIG. 5.

As may be generally understood with reference to FIGS. 5 and 6, at least some of, or more specifically each of, the frame panels 36, 38, 40, 42, 50, 52, 54 can include mating parts for being respectively mated with other mating parts of the frame 34 to form a mated joint. In FIGS. 5 and 6, neither the mating parts nor the mated joints are identified by reference numerals. In contrast, at least some of the mating parts are identified by reference numerals in FIGS. 7-21, as discussed in greater detail below. The mating parts can fit and interlock together for increased strength.

In the depicted embodiment, the mated joints are configured in a manner that restricts the frame parts (e.g., frame panels 36, 38, 40, 42, 50, 52, 54 and lower gusset panels 66 (see, e.g., FIG. 8) from being forced apart from one another, for example when the bollard post 22 is impacted by a vehicle. For example, at least some of, or more specifically each of, the panels 36, 38, 40, 42, 50, 52, 54, 58, 66 can be a steel plate, the receptacle tube 32 can a steel pipe, and the channels 57, 62 can be steel channels, and these steel parts can be respectively welded together in a manner that restricts these parts from being forced apart from one another, for example when the bollard post 22 is impacted by a vehicle. For at least some of, at least a majority of, or each of the mated joints of the frame 34, the mated together parts of the mated joint can be welded together in a manner that restricts the frame parts from being forced apart from one another, for example when the bollard post 22 is impacted by a vehicle.

Referring to FIG. 4, female mating parts of the crosswise-intermediate panel 54 can include cavities in the form of holes or more specifically rectangular slots 54S extending through the crosswise-intermediate panel, and cavities in the form of holes or more specifically rectangular edge recesses 54R. Relatively male-like mating parts or portions of the crosswise-intermediate panel 54 can include rectangular edge protrusions 54P and other predetermined portions 540 of the crosswise-intermediate panel configured for fitting into respective cavities of other frame members. At least two or more of the series of rearwardly-positioned slots 54S can extend crosswise to one another and be open to one another to collectively define a keyway or multi-part hole with legs or portions for receiving respective portions of more than one of the other frame parts, for example respective portions of the rearward upright-intermediate panel 52 (see, e.g., FIGS. 7 and 8) and several of the lower gusset panels 66 (see, e.g., FIGS. 8 and 9), as discussed in greater detail below.

Figure 7:
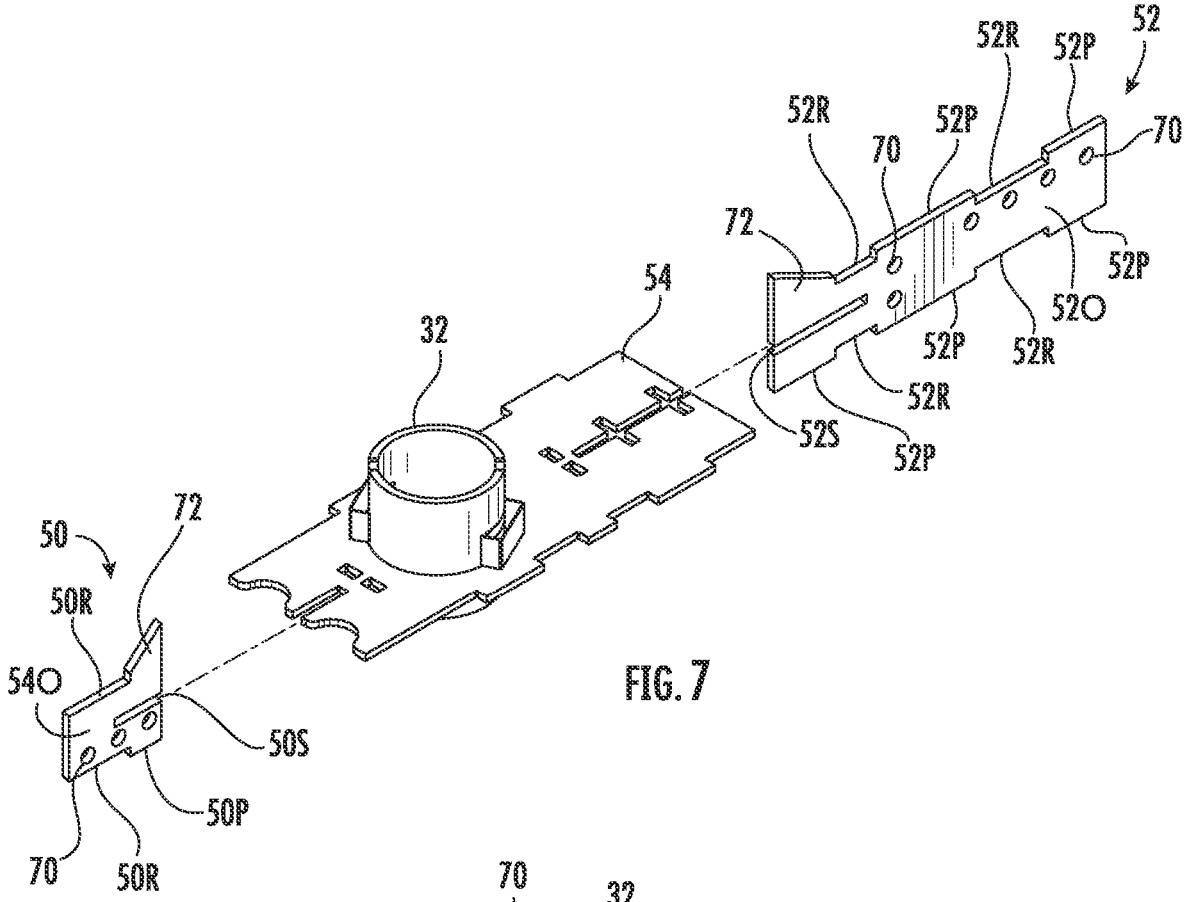
FIG. 7 is a front, top-right, partially exploded perspective view of selected components of the base of FIG. 1, including the components of FIG. 4 in their assembled configuration.

Referring to FIG. 7, female mating parts of the forward upright-intermediate panel 50 can include cavities in the form of holes or more specifically a rectangular slot 50S extending through the forward upright-intermediate panel, and cavities in the form of holes or more specifically rectangular edge recesses 50R. Relatively male-like mating parts or portions of the forward upright-intermediate panel 50 can include a rectangular edge protrusion 50P and another predetermined portion 500 of the forward upright-intermediate panel configured for fitting into respective cavities of other frame members.

Female mating parts of the rearward upright-intermediate panel 52 can include cavities in the form of holes or more specifically a rectangular slot 52S extending through the rearward upright-intermediate panel, and cavities in the form of holes or more specifically rectangular edge recesses 52R. Relatively male-like mating parts or portions of the rearward upright-intermediate panel 52 can include rectangular edge protrusions 52P and another predetermined portion 520 of the rearward upright-intermediate panel configured for fitting into respective cavities of other frame members.

At least one of, or each of the upright-intermediate panels 50, 52 can include one or more bar-receiving holes 70 extending therethrough, as will be discussed in greater detail below. An end portion of at least one of the upright-intermediate panels 50, 52 can include an upwardly inclined upper edge at least partially defining an area of increased height or a triangular gusset portion 72 of the upright-intermediate panel. The gusset portions 72 (e.g., inner ends) of the upright-intermediate panels 50, 52 can be engaged against and connected to (e.g., welded to) opposite front and rear sides of the outer surface of the receptacle tube 32. In the depicted embodiment, the gusset portions 72 are configured to restrict relative rotation between respective components of the base 24.

Figure 8:
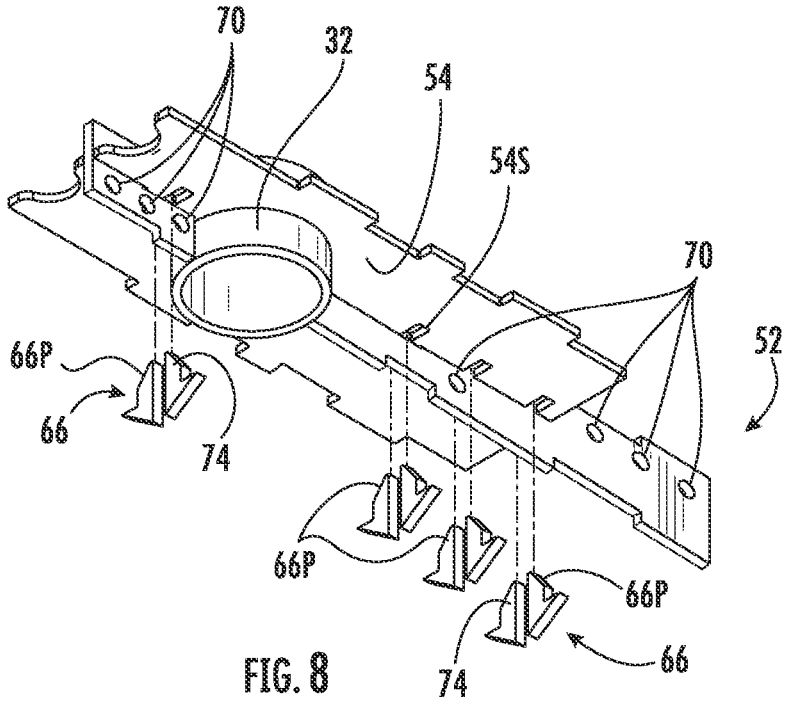
FIG. 8 is a front, bottom-right, partially exploded perspective view of selected components of the base of FIG. 1, including the components of FIG. 7 in their assembled configuration.
Figure 9:
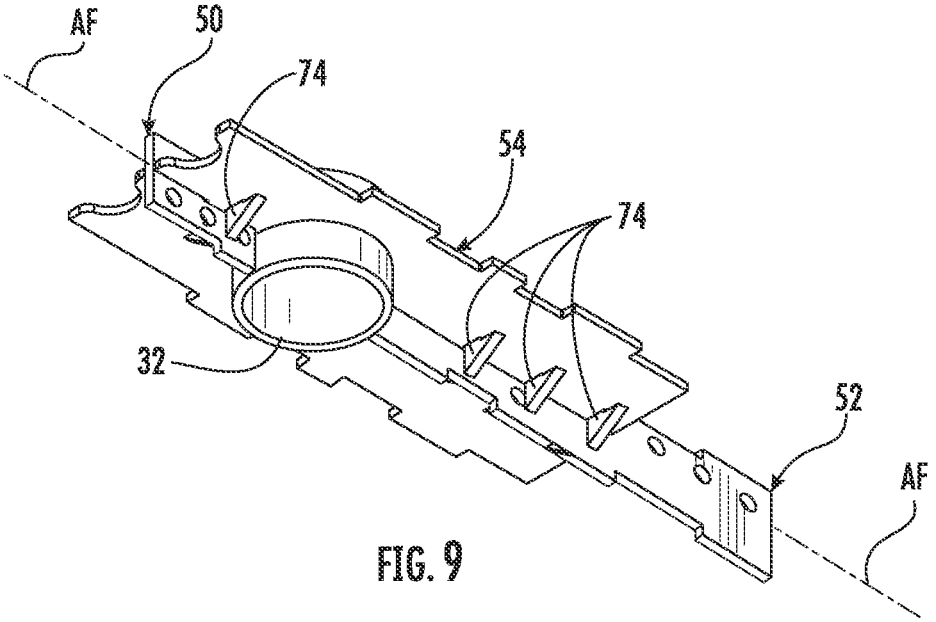
FIG. 9 is a front, bottom-right view of the components of FIG. 8 in their assembled configuration.

Referring to FIG. 8, the lower gusset panels 66 can include relatively male-like mating parts or portions in the form of triangular edge protrusions 66P configured for fitting into respective slot cavities 54S of the crosswise-intermediate panel 54. Referring also to FIG. 9, upper and lower end portions of at least one of the lower gusset panels 66 can include an inclined edge at least partially defining triangular gusset portions 74 of the lower gusset panels. The gusset portions 74 of the upright-intermediate panels 50, 52 can be engaged against and connected to (e.g., welded to) the intermediate panels 50, 52, 54 respectively. In the depicted embodiment, the gusset panels 66 are configured to restrict relative rotation between respective components of the frame 34.

Figure 10:
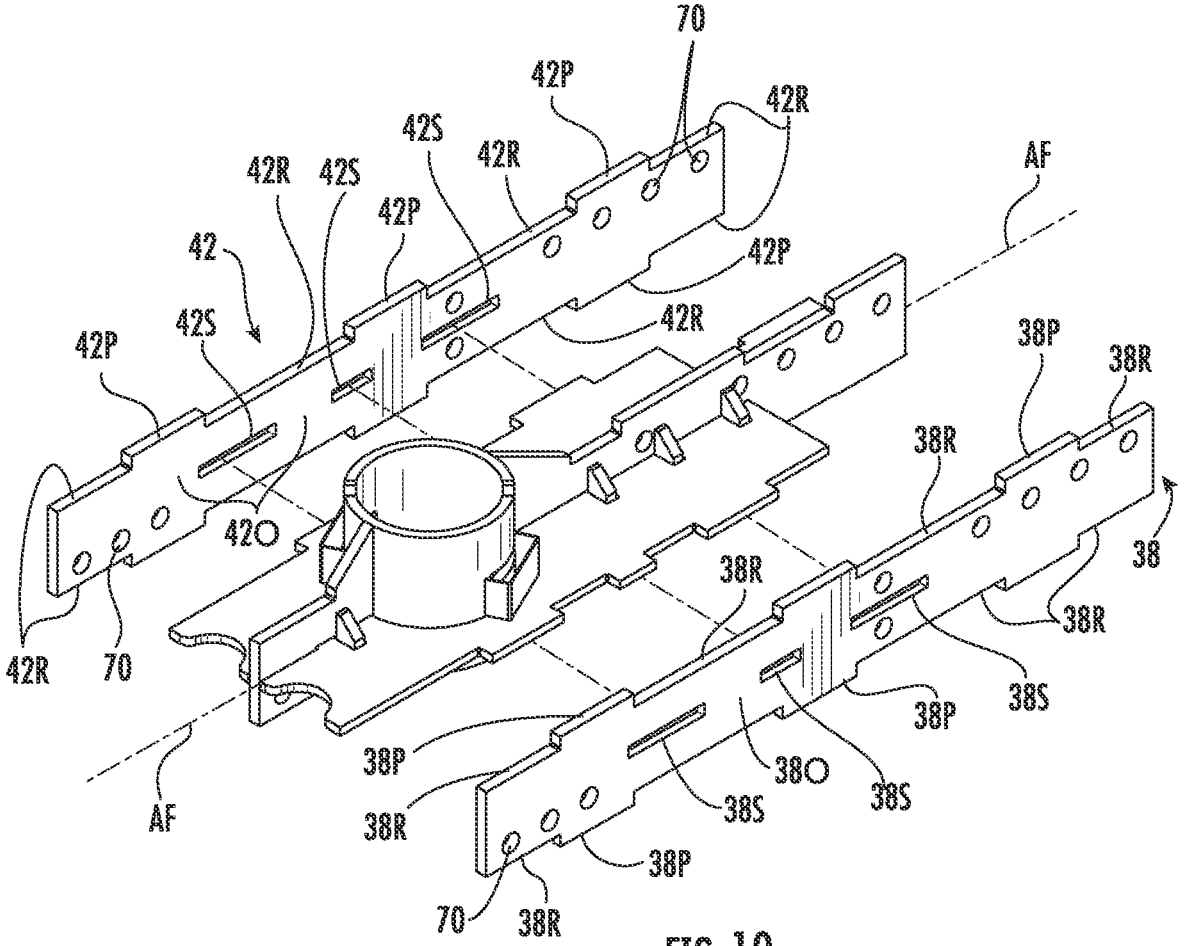
FIG. 10 is a front, top-right, partially exploded perspective view of selected components of the base of FIG. 1, including the components of FIG. 8 in their assembled configuration.

Referring to FIG. 10, female mating parts of the right and left side panels 38, 42 can include cavities in the form of holes or more specifically rectangular slots 38S, 42S extending through the side panels, and cavities in the form of holes or more specifically rectangular edge recesses 38R, 42R. Relatively male-like mating parts or portions of the right and left side panel 38, 42 can include rectangular edge protrusions 38P, 42P and other predetermined portions 380, 420 of the side panels configured for fitting into respective cavities of other frame members. At least one of, or each of the right and left side panel 38, 42 can include one or more bar-receiving holes 70 extending therethrough.

As will be discussed in greater detail below for the embodiment depicted in the drawings, the bar-receiving holes 70 are configured for having horizontally or crosswise-extending reinforcing bars 86 (see, e.g., FIG. 21) extend therethrough at different elevations, for example an upper elevation that is above the frame axis AF and a lower elevation that is below the frame axis AF. More specifically, at least some of or each of one or more forwardly-positioned bar-receiving holes 70 in the side panels 38, 42 and forward upright-intermediate panel 50 can be positioned below the frame axis AF, and at least some of or each of one or more rearwardly-positioned bar-receiving holes 70 in the side panels 38, 42 and rearward upright-intermediate panel 50 can be positioned above the frame axis AF. There can be pairs of intermediately-positioned bar-receiving holes 70 positioned between the series of forwardly-positioned bar-receiving holes 70 and the series of rearwardly-positioned bar-receiving holes 70. For each pair of intermediately-positioned bar-receiving holes 70, an upper hole of the pair can be positioned above the frame axis AF, and a lower hole of the pair can be positioned below the frame axis AF, as discussed in greater detail below.

Figure 11:
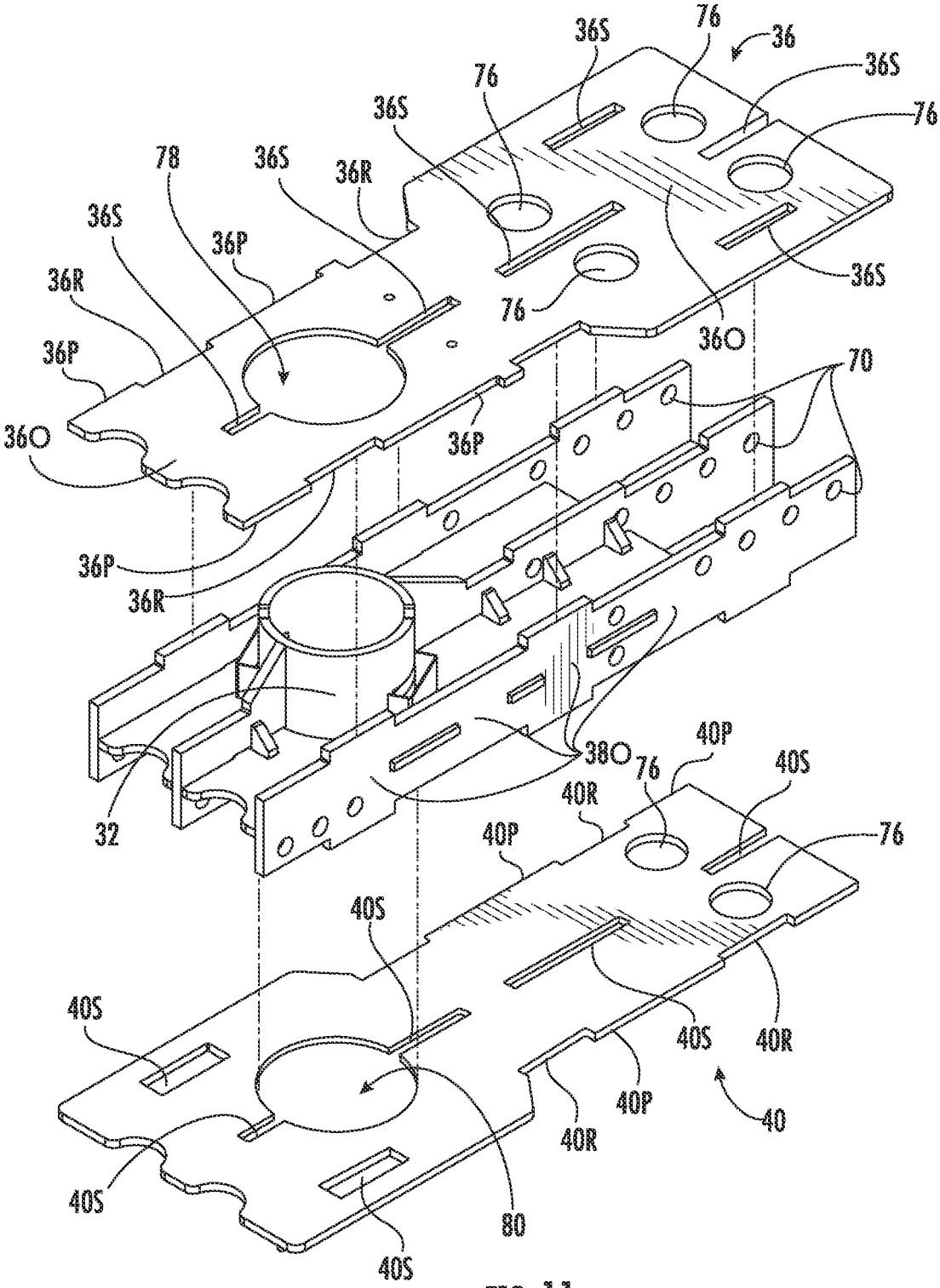
FIG. 11 is a front, top-right, partially exploded perspective view of the base of FIG. 1, including the components of FIG. 10 in their assembled configuration.

Referring to FIG. 11, female mating parts of the upper and lower panels 36, 40 can include cavities in the form of holes or more specifically rectangular slots 36S, 30S extending through the panel, and cavities in the form of holes or more specifically rectangular edge recesses 36R, 40R. Relatively male-like mating parts or portions of the upper and lower panels 36, 40 can include rectangular edge protrusions 36P, 40P and other predetermined portions 360, 400 of the panel configured for fitting into respective cavities of other frame members. The upper and lower panels 36, 40 can include one or more substrate-receiving holes 76 extending therethrough, as will be discussed in greater detail below.

Figure 12:
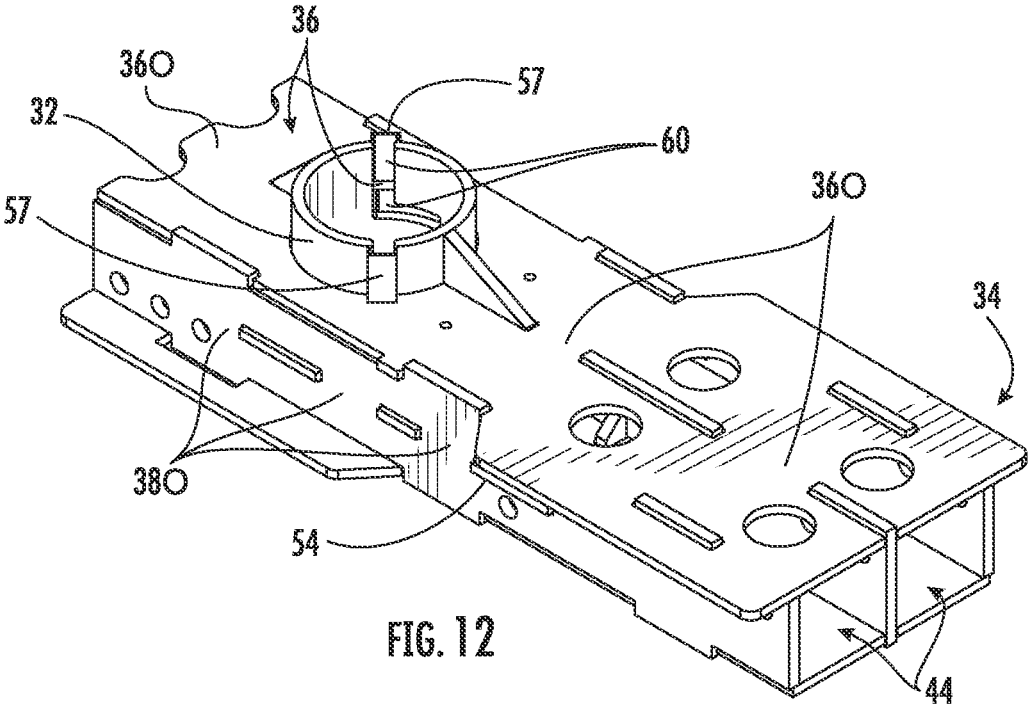
FIG. 12 is a rear, top-right perspective view of the components of FIG. 11 in their assembled configuration.

The receptacle tube 32 can extend upwardly through a post-receiving hole 78 in the upper panel 36, and downwardly into a post-receiving hole 80 of the lower panel 40. The receptacle tube 32 can be connected (e.g., welded) to the upper and lower panels 36, 40. Referring to FIG. 12, the upper channel pieces 57 can be connected (e.g., welded) to both the outer surface of the receptacle tube 32 and the upper surface of the upper panel 36, so that the upper channel pieces 66 cover, without obstructing, the vertically extending legs of the L-shaped mounting slots 60.

In FIG. 12, a representative one of the L-shaped mounting slots 60 is depicted. In the depicted embodiment, the mounting slots 60 are inwardly open to the space surrounded by the receptacle tube 32. When the bollard assembly 20 is configured to allow the bollard post 22 to be removable from the base 24 after installation of the bollard assembly, features are included to protect the L-shaped mounting slots 60 from the uncured flowing substrate (e.g., concrete) while the bollard assembly is being installed. For example, the respective channel pieces 57, 62 (FIGS. 4 and 5), portions of the upper panel 36, and portions of the crosswise-intermediate panel 54 form chambers, barriers, and/or boundaries that restrict the uncured, flowing substrate (see, e.g., substrate 90 of FIGS. 22-24) from entering into and obstructing the L-shaped mounting slots 60. The channel pieces 57, 62 and L-shaped mounting slots 60 may be omitted, for example when the bollard post 22 is not removable from the base 24.

Figure 13:
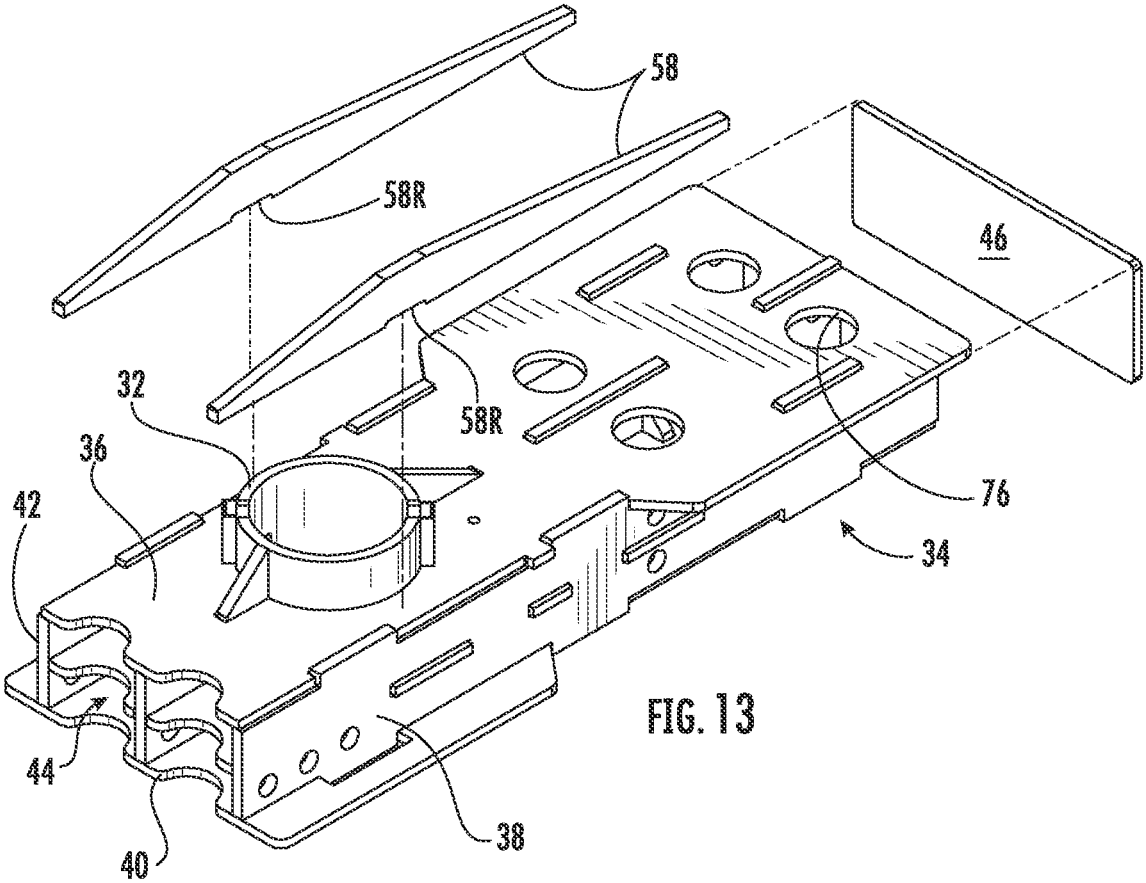
FIG. 13 is a front, top-right, partially exploded perspective view of selected components of the base of FIG. 1, including the components of FIG. 11 in their assembled configuration.
Figure 14:
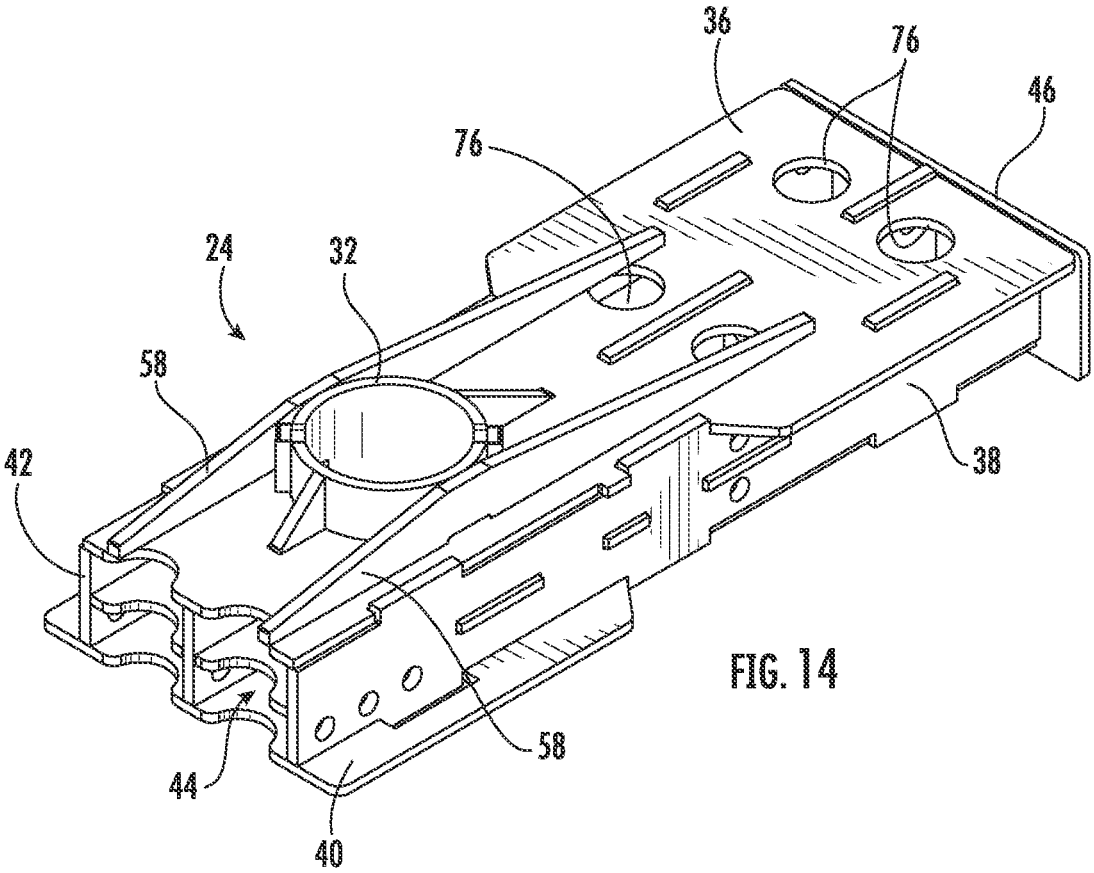
FIG. 14 is a front, top-right perspective view of the base of FIG. 1.

Referring to FIGS. 13 and 14, the rear panel 46 can be connected (e.g., welded) to rear ends of one or more of (e.g., each of) the outer panels 36, 38, 40, 42 to obstruct the rear opening(s) to the frame interior space 44. In contrast, In the depicted embodiment, the front opening or openings to the frame interior space 44 remain open for allowing the flowing, uncured substrate (see, e.g., substrate 90 of FIGS. 22-24) to flow into the frame interior space during installation of the base 24. Similarly for the embodiment depicted in the drawings, the substrate-receiving holes 76 of the upper and lower panels 36, 40 are configured for allowing the flowing, uncured substrate to flow into the frame interior space 44 during installation of the base 24.

The triangular upper gusset panels 58 can be connected (e.g., welded) to both the outer surface of the receptacle tube 32 and the upper surface of the upper panel 36. The upper gusset panels 58 can include cavities in the form of holes or more specifically rectangular edge recesses 58R. It is believed that during the welding of the upper gusset panels 58 to the receptacle tube 32 and the upper panel 36, the edge recesses 58R can be at least partially filled with the welding material in a manner that seeks to increase the strength of the welds.

Figure 15:
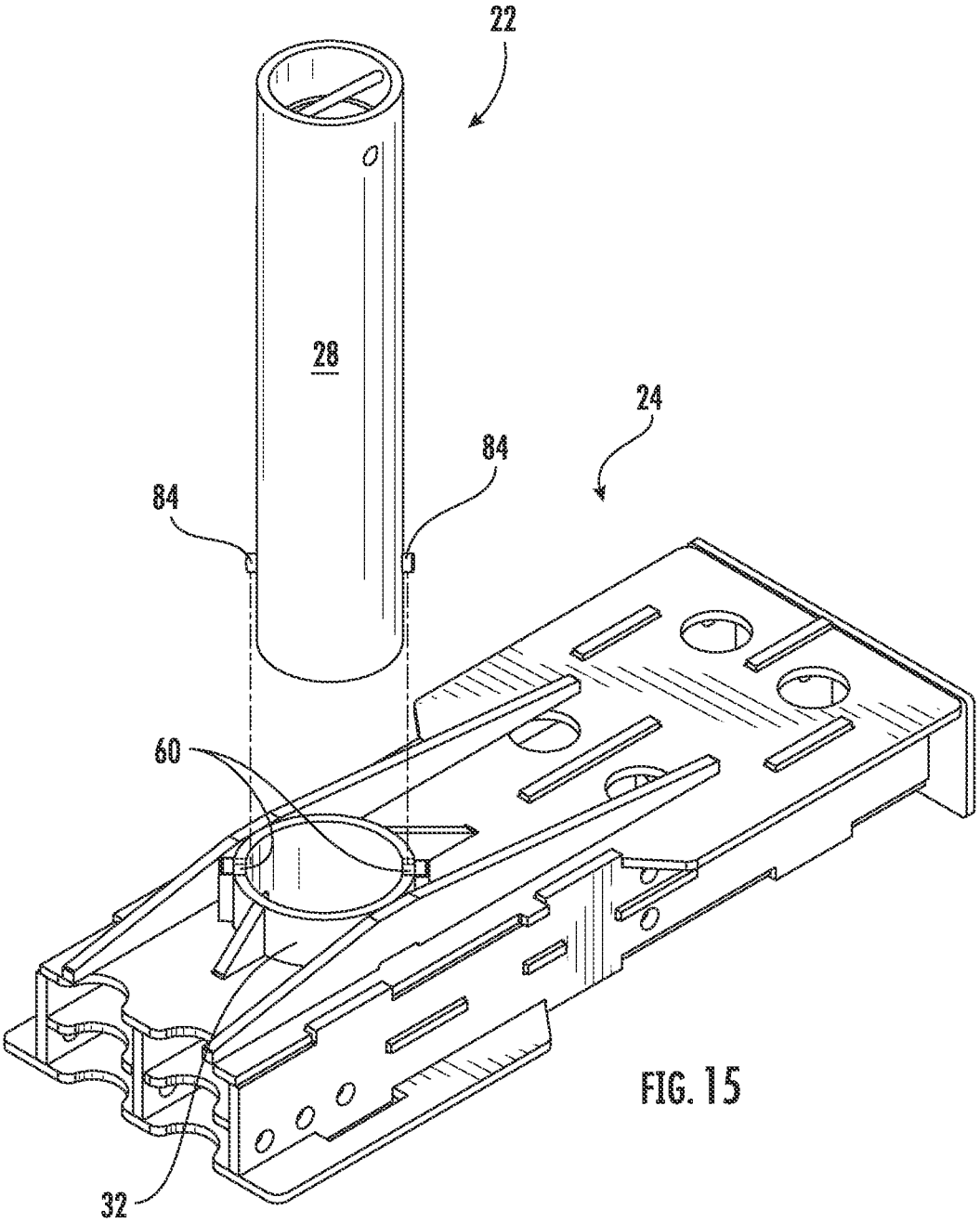
FIG. 15 is a front, top-right, partially exploded perspective view of the bollard assembly of FIG. 1.
Figure 16:
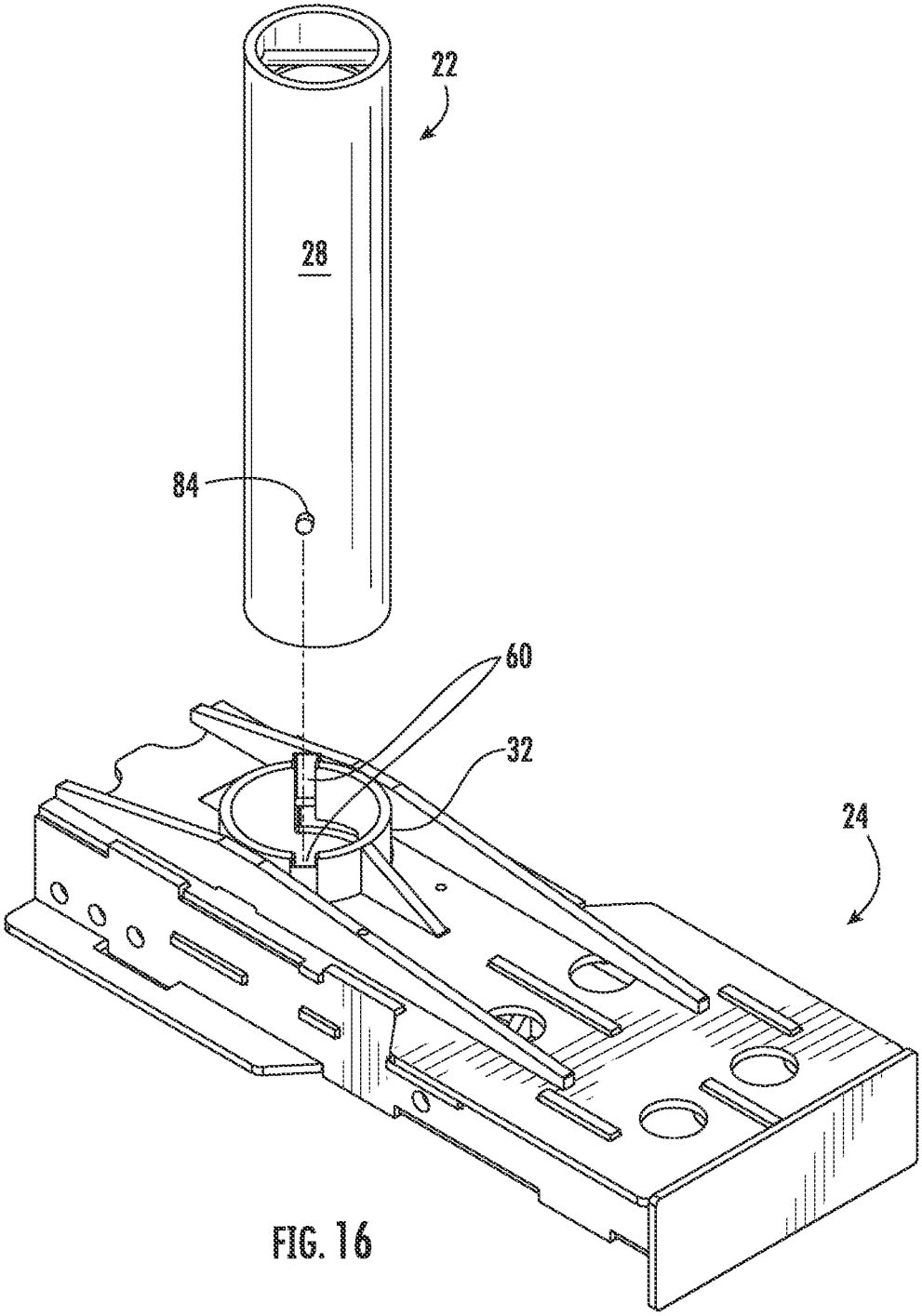
FIG. 16 is a rear, top-right, partially exploded perspective view corresponding to FIG. 15.
Figure 17:
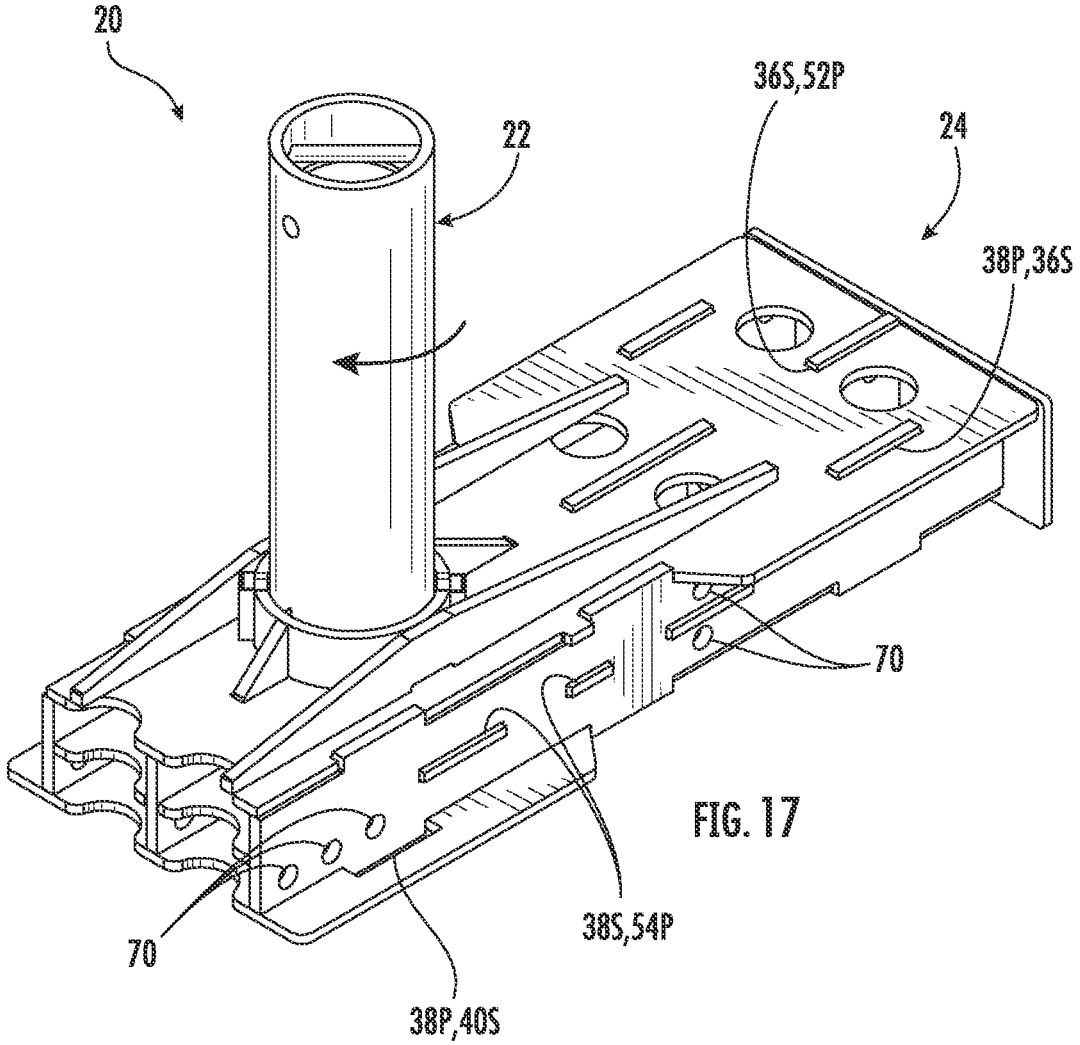
FIG. 17 is like FIG. 1, except for further schematically depicting that the bollard post of the bollard assembly has been rotated to secure the lower end portion of the bollard post to the base.

Referring to FIGS. 15 and 16, at least one crosswise mounting mechanism or pin 84 can be fixedly connected to, span the diameter of, and protrude outwardly from opposite sides of the bollard post outer tube 28. The bollard post 22 can be lowered into the receptacle tube 32 so that the opposite end portions of the mounting pin 84 pass downwardly through the upright portions of the L-shaped mounting slots 60. Then, as schematically depicted by an arrow in FIG. 17, the bollard post 22 can be rotated so that the opposite end portions of the mounting pin 84 travel in the horizontal portions of the L-shaped mounting slots 60 so that the opposite end portions of the mounting pin, and thus the bollard post, are restricted from moving vertically.

Various features can be provided to restrict undesired removal of the bollard post 22 from the base 24 and/or allow removal of the bollard post under only predetermined conditions. For example, a key-operated locking mechanism (not shown) can releasably lock together the bollard post 22 and receptacle tube 32, an interference fit can be defined between the bollard post and receptacle tube 32, and/or other features may be provided for allowing removal of the bollard post 22 under only predetermined conditions. Alternatively, the bollard post 22 can be permanently, fixedly mounted (e.g., welded) to the receptacle tube 32. In the depicted embodiment, the frame 34 is connected to the bollard post 22 by way of the receptacle tube 32, wherein the receptacle tube 32 is an example of a mount for the bollard post. Other mounts are within the scope of this disclosure. For example, it is believed that the receptacle tube 32 may be omitted and the bollard post 22 may be more directly connected to respective portions of the frame 34. As another example, the receptacle tube 32 may be referred to as being part of the frame 34.

Figure 19:
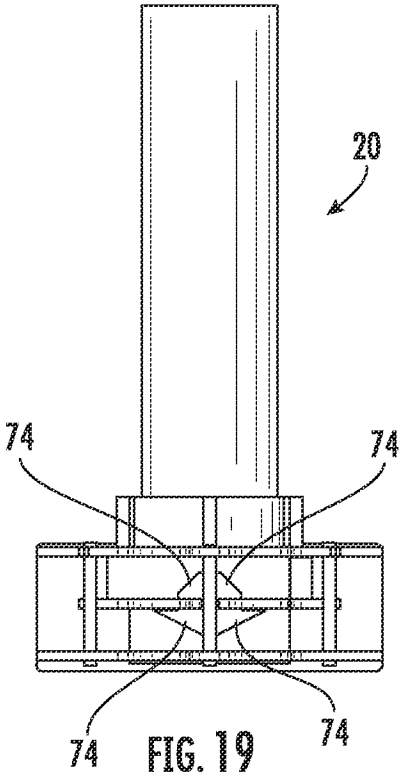
FIG. 19 is a front elevation view of the bollard assembly of FIG. 1.
Figure 18:
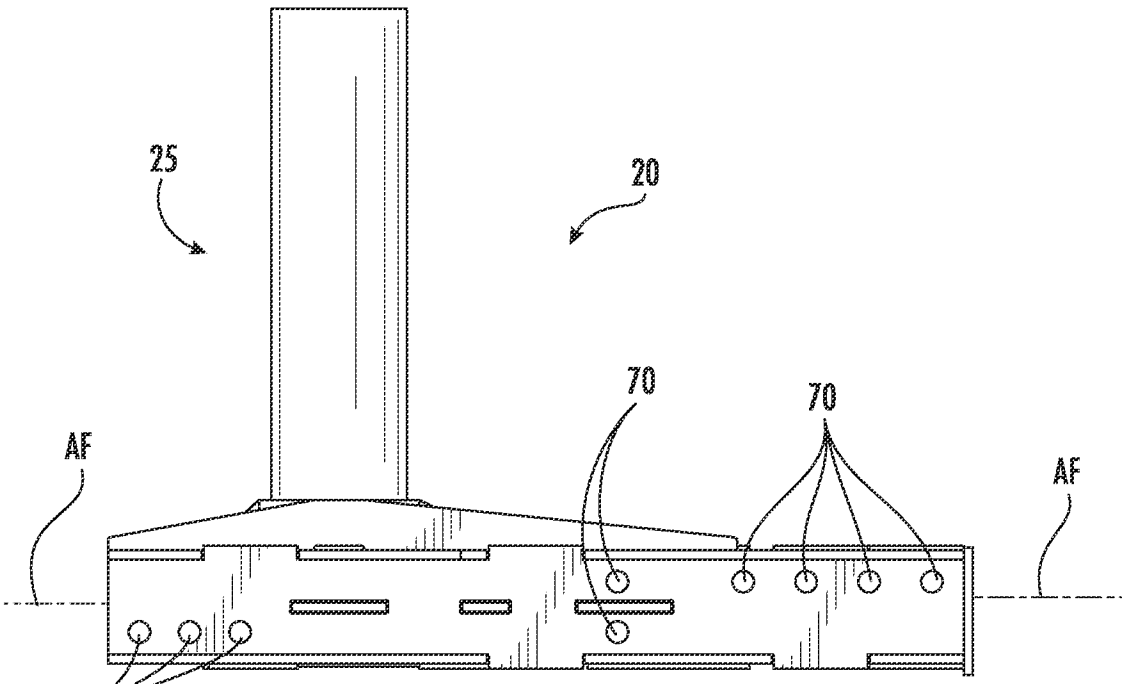
FIG. 18 is a right elevation view of the bollard assembly of FIG. 1, wherein a left elevation view of the bollard assembly of FIG. 1 is a mirror image of FIG. 18.
Figure 20:
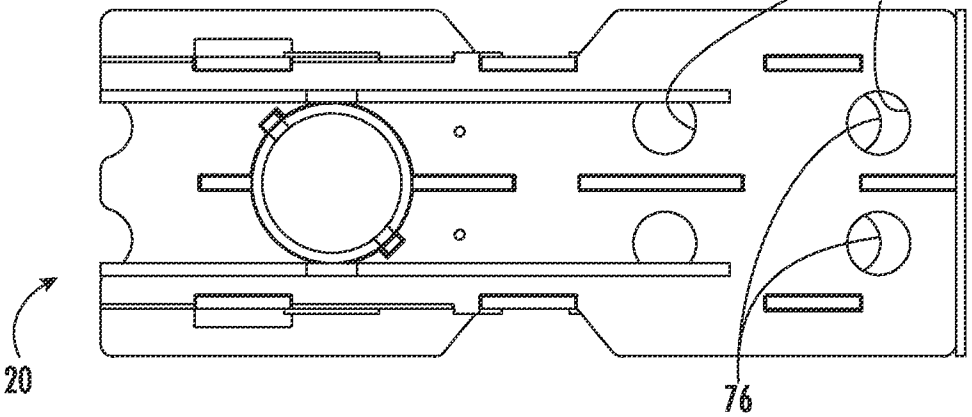
FIG. 20 is a top plan view of the bollard assembly of FIG. 1.
Figure 21:
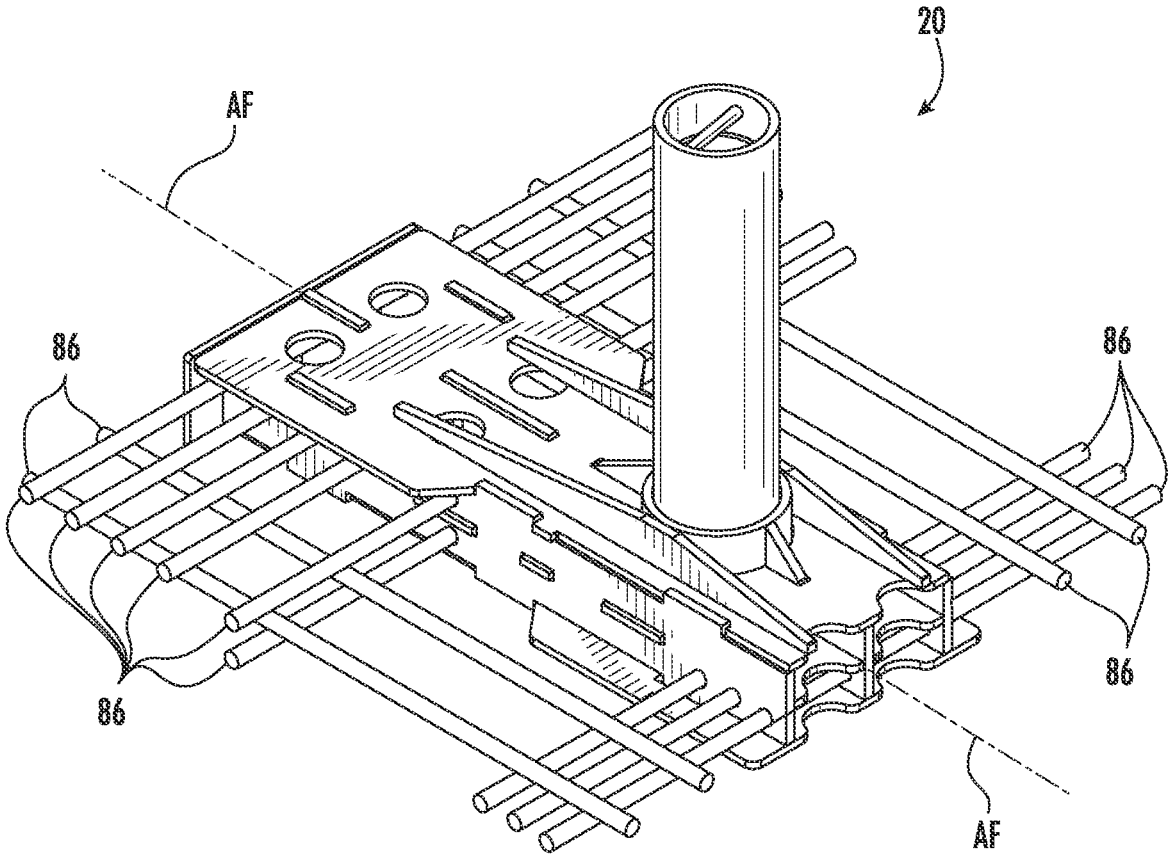
FIG. 21 is a front, top-right perspective view of the bollard assembly of FIG. 1 further including reinforcing bars, in accordance with an embodiment of this disclosure.

Whereas FIGS. 18-20 depict the bollard assembly 20 in an assembled state in which it may be transported to an installation site. Referring to FIG. 21, reinforcing bars 86 can be mounted to the bollard assembly before it is embedded in the substrate 90 (FIGS. 22-24). For example, FIG. 21 depicts the bollard assembly after reinforcing bars 86 (e.g., rebar) have been mounted (e.g., welded) to frame 34. In the depicted embodiment, the bar-receiving holes 70 are respectively concentric in side elevation views of the base 3, such that each piece of rebar 86 that extends crosswise to the axis AF of the frame 34 extends through (e.g., is inserted through) at least two, or more specifically through three, of the bar-receiving holes 70.

More specifically and referring to FIGS. 18 and 21, at least some of or each of one or more forwardly-positioned crosswise-extending pieces of rebar 86 can be mounted by way of respective bar-receiving holes 70 so as to be positioned below the frame axis AF, and at least some of or each of one or more rearwardly-positioned crosswise-extending pieces of rebar 86 can be mounted by way of respective bar-receiving holes 70 so as to be positioned above the frame axis AF. A pair of intermediately-positioned crosswise-extending rebar 86 can be positioned between the forward and rearward crosswise rebar 86. One of the pair of intermediately-positioned crosswise rebar 86 can be positioned above, and the other of the pair can be positioned below, the frame axis AF. As shown in FIG. 21, additional rebar 86 can extend along the frame axis AF. Crossing pieces of rebar 86 can be connected (e.g., welded) to one another.

FIG. 22 schematically depicts an example of the bollard assembly 20 including rebar 86 embedded in at least one substrate 90 supported by a subgrade 92. In the example depicted in FIG. 22, the substrate 90 includes a main concrete slab 94 (e.g., high-strength, 5000 psi concrete) on the subgrade 92, and a reveal layer 96 on top of the main concrete slab. The thickness of the main concrete slab 94 is designated by "TC", and the thickness of the reveal 96 is designated by "TR". The main concrete slab 94 typically has a thickness TC greater than the thickness TR of the reveal 96. The reveal layer 96 may be a continuation of the concrete slab 94, may be an architectural concrete that has a relatively superior surface finish, may include paving blocks, and/or may be any other suitable upper portion of the substrate 90.

In accordance with an example of a method of installing the bollard assembly 20, after the subgrade 92 is compacted and/or otherwise configured in a predetermined manner, masonry blocks or other suitable supports 98 can be placed upon the subgrade in a predetermined manner, and the bottom of the frame 34 can be placed upon the supports 98 in a predetermined manner (e.g., so that, when supplied, the uncured flowing substrate can flow beneath the frame 34 and through the substrate-receiving holes 76 and front openings to the frame interior space 44).

In the depicted embodiment, the frame 34 is securely embedded and anchored in the substrate 90, including each of the upper and lower frame flanges 55, 56 being securely embedded and anchored in the substrate. For each of the upper frame flanges 55, one or more portions of the substrate 90 can extend continuously from the lower surface of the upper frame flange to the subgrade 92, one or more portions of the substrate can extend continuously from the upper surface of the upper frame flange to the upper surface of the substrate, and rebar 86 can be embedded in and reinforce the one or more portions of the substrate extending continuously from the lower surface of the upper frame flange to the lower surface of the substrate. Similarly, For each of the lower frame flanges 56, one or more portions of the substrate 90 can extend continuously from the lower surface of the lower frame flange to the subgrade 92, one or more portions of the substrate can extend continuously from the upper surface of the lower frame flange to the upper surface of the substrate, and rebar 86 can be embedded in and reinforce the one or more portions of the substrate extending continuously from the upper surface of the lower frame flange to the upper surface of the substrate.

Reiterating from above, the bollard assembly 20 can be configured as, and used as, a stand-alone security bollard, for example a single stand-alone security bollard capable of stopping a heavy vehicle traveling at high speed. For example, for enhancing performance of the bollard assembly 20 when the vehicle impacts the front 25 of the bollard post 22, the lower frame flanges 56, which extend outward beyond the upright side plates 38, 42, bear against the above substrate 90. Similarly, the upper frame flanges 55, which extend outward beyond the upright side plates 38, 42, bear against the below substrate 90. As another example, the frame rear panel 46 increases the surface area of the frame 34 that is bearing against the substrate positioned rearwardly of the base 24 in a manner that provides or enhances a plowing affect during a vehicle impact.

Reiterating from above, the bollard assembly 20 depicted in the drawings is configured to be capable of being used as a shallow-mount security bollard. For example, the base 24 can have a vertical height of about thirteen inches as measured from the lower surface of the lower panel 40 to the upper edge of the receptacle tube 32. More generally, the base 24 can have a vertical height in a range of from about ten inches to about sixteen inches, a vertical height of less than about seventeen inches, a vertical height of less than about sixteen inches, a vertical height of less than about fifteen inches, a vertical height of less than about fourteen inches, or any values or subranges therebetween, for example as measured from the lower surface of the lower panel 40 to the upper edge of the receptacle tube 32.

As another example, the base 24 can have a vertical height of about nine inches as measured from the lower surface of the lower panel 40 to the upper surface of the upper panel 36. More generally, the base 24 can have a vertical height in a range of from about seven inches to about eleven inches, a vertical height of less than about twelve inches, a vertical height of less than about eleven inches, a vertical height of less than about ten inches, or any values or subranges therebetween, for example as measured from the lower surface of the lower panel 40 to the upper surface of the upper panel 36.

As another example, the upper edge of the receptacle tube 32 can be about flush with the upper surface of the embedding substrate 90, and the embedding substrate can have a vertical thickness of about twenty-four inches. More generally, the embedding substrate 90 can have a vertical thickness in a range of from about twelve inches to about thirty inches, a vertical thickness in a range of from about fourteen inches to about twenty-eight inches, a vertical thickness in a range of from about twelve inches to about twenty-six inches, a vertical thickness of less than about thirty inches, a vertical thickness of less than about twenty-eight inches, a vertical thickness of less than about twenty-six inches, a vertical thickness of less than about twenty-four inches, a vertical thickness of less than about twenty-two inches, a vertical thickness of less than about twenty inches, a vertical thickness of less than about eighteen inches, a vertical thickness of less than about sixteen inches, a vertical thickness of less than about fourteen inches, or any values or subranges therebetween. As additional examples for when the embedding substrate includes a main concrete slab 94 and reveal 96, the main concrete slab 94 can have a thickness TC in a range of from about twelve inches to about twenty-four inches, and the reveal 96 can have a thickness TR of about four inches.

At least partially reiterating from above, the bollard assembly 20 depicted in the drawings is configured to be capable of being used as a stand-alone security bollard. For example, FIG. 23 depicts a straight row of the bollard assemblies 20, each including rebar 86, with their bases 24 embedded in a substrate 90, wherein adjacent bollard assemblies are not connected with steel or non-concrete structural members and a gap "G" of at least two inches exists between the rebar of adjacent bollard assemblies. As another example, FIG. 24 depicts a series of the bollard assemblies 20 arranged in a straight row that transitions to a curved row, wherein adjacent bollard assemblies are not connected with steel or non-concrete structural members and a gap "G" of at least two inches exists between the rebar of adjacent bollard assemblies. The bollard assemblies 20 being capable of standing alone offers many advantages (e.g., efficiencies) associated with ease of installation, ease of repair, and the like. Alternatively, the bollard assembly 20 can be used in non-stand-alone installations, and it is believed that they can also be used in non-shallow-mount installations, if desired.

Reiterating from above, it is within the scope of this disclosure for one or more of the terms "substantially," "about," "approximately," and/or the like, to qualify each of the adjectives and adverbs of the foregoing disclosure, for the purpose of providing a broad disclosure. As an example, it is believed that those of ordinary skill in the art will readily understand that, in different implementations of the features of this disclosure, reasonably different engineering tolerances, precision, and/or accuracy may be applicable and suitable for obtaining the desired result. Accordingly, it is believed that those of ordinary skill will readily understand usage herein of the terms such as "substantially," "about," "approximately," and the like.

In the specification and drawings, examples of embodiments have been disclosed. The present invention is not limited to such exemplary embodiments. The use of the term "and/or" includes any and all combinations of one or more of the associated listed items. Unless otherwise noted, specific terms have been used in a generic and descriptive sense and not for purposes of limitation.

The invention claimed is:

1. A bollard assembly, comprising:

a base comprising a plurality of panels extending at least partially around an interior space, wherein:

the plurality of panels comprises opposite upper and lower panels that are spaced apart from one another, right and left panels that are spaced apart from one another and extend upright between the upper and lower panels, and an inner panel connected to at least one of the plurality of panels, the inner panel is positioned between, and spaced apart from each of, the upper and lower panels, and the inner panel extends within the interior space so that:

the inner panel at least partially divides the interior space, an upper portion of the interior space is positioned above the inner panel, and a lower portion of the interior space is positioned below the inner panel; and a bollard post extending upwardly from the interior space through a hole in the upper panel, wherein the bollard post extends through a hole in the inner panel, the inner panel extends from the right panel to the left panel, the right panel extends from the lower panel to the upper panel, and the left panel extends from the lower panel to the upper panel.

2. The bollard assembly according to claim 1, wherein a connection between the right panel and the inner panel comprises a protrusion of the inner panel extending into a hole in the right panel; and the right panel extends completely around the hole in the right panel.

3. The bollard assembly according to claim 1, wherein the inner panel is smaller than each of the upper and lower panels.

4. The bollard assembly according to claim 1, wherein the inner panel has a shorter length than each of:

the upper and lower panels, and the right and left panels.

5. The bollard assembly according to claim 1, wherein:

each of the right and left panels has a upper portion and a lower portion, the upper portion of each of the right and left panels defines an upper bar-receiving hole positioned above the inner panel, and the lower portion of each of the right and left panels defines a lower bar-receiving hole positioned below the inner panel.

6. The bollard assembly of claim 5, further comprising:

an upper reinforcing bar extending through the upper bar-receiving holes in the upper portions of the right and left panels, respectively; and a lower reinforcing bar extending through the lower bar-receiving holes in the lower portions of the right and left panels, respectively, wherein the inner panel is positioned between the upper and lower reinforcing bars.

7. A bollard assembly, comprising:

a base comprising a plurality of panels extending at least partially around an interior space, wherein the plurality of panels comprises opposite upper and lower panels that are spaced apart from one another, and right and left panels that are spaced apart from one another and extend upright between the upper and lower panels, wherein a rear portion of the upper panel is wider than a rear portion of the lower panel so that a margin of the rear portion of the upper panel at least partially forms an upper flange, and a front portion of the lower panel is wider than a front portion of the upper panel so that a margin of the front portion of the lower panel at least partially forms a lower flange.

8. The bollard assembly according to claim 7, wherein the upper flange extends less than one-half the length of the base.

9. The bollard assembly according to claim 8, wherein the upper flange extends between one-half and one-quarter the length of the base.

10. The bollard assembly according to claim 7, wherein: the lower flange extends less than one-half the length of the base.

11. The bollard assembly according to claim 10, wherein the lower flange extends between one-half and one-quarter the length of the base.

12. The bollard assembly according to claim 7, wherein:

the upper flange extends between one-half and one-quarter the length of the base; and the lower flange extends between one-half and one-quarter the length of the base.

13. A bollard assembly, comprising:

a base comprising a plurality of panels extending at least partially around an interior space, wherein:

the plurality of panels comprises opposite upper and lower panels that are spaced apart from one another, right and left panels that are spaced apart from one another and extend upright between the upper and lower panels, and an inner panel connected to at least one of the plurality of panels, and the inner panel is positioned between, and spaced apart from each of, the upper and lower panels; and a bollard post extending upwardly through the upper panel, wherein the bollard post extends through the inner panel, wherein the inner panel is a first inner panel, a second inner panel is connected to at least one of the plurality of panels, the second inner panel is positioned between, and spaced apart from each of, the right and left panels, the first and second inner panels are connected to one another and extend crosswise to one another, and a reinforcing bar extends through each of the second inner panel, the right panel, and the left panel.

14. The bollard assembly of claim 13, wherein:

the reinforcing bar is an upper reinforcing bar;

the bollard assembly further comprises a lower reinforcing bar extending through each of the second inner panel, the right panel, and the left panel; and the first inner panel is positioned between the upper and lower reinforcing bars.

15. A bollard assembly, comprising:

a base comprising a plurality of panels extending at least partially around an interior space, wherein:

the plurality of panels comprises opposite upper and lower panels that are spaced apart from one another, right and left panels that are spaced apart from one another and extend upright between the upper and lower panels, and an inner panel connected to at least one of the plurality of panels, and the inner panel is positioned between, and spaced apart from each of, the upper and lower panels; and a bollard post extending upwardly through the upper panel, wherein the bollard post extends through the inner panel, and the inner panel is smaller than each of the upper and lower panels.

16. A bollard assembly, comprising:

a base comprising a plurality of panels extending at least partially around an interior space, wherein:

the plurality of panels comprises opposite upper and lower panels that are spaced apart from one another, right and left panels that are spaced apart from one another and extend upright between the upper and lower panels, and an inner panel connected to at least one of the plurality of panels, and the inner panel is positioned between, and spaced apart from each of, the upper and lower panels; and a bollard post extending upwardly through the upper panel, wherein the bollard post extends through the inner panel, and wherein the inner panel has a shorter length than each of:

the upper and lower panels, and the right and left panels.

17. A bollard assembly, comprising:

a base comprising a plurality of panels extending at least partially around an interior space, wherein:

the plurality of panels comprises opposite upper and lower panels that are spaced apart from one another, right and left panels that are spaced apart from one another and extend upright between the upper and lower panels, and an inner panel connected to at least one of the plurality of panels, and the inner panel is positioned between, and spaced apart from each of, the upper and lower panels; and a bollard post extending upwardly through the upper panel, wherein the bollard post extends through the inner panel, and wherein:

each of the right and left panels has a upper portion and a lower portion, the upper portion of each of the right and left panels defines an upper bar-receiving hole positioned above the inner panel, and the lower portion of each of the right and left panels defines a lower bar-receiving hole positioned below the inner panel.

18. The bollard assembly of claim 17, further comprising:

an upper reinforcing bar extending through the upper bar-receiving holes in the upper portions of the right and left panels, respectively; and a lower reinforcing bar extending through the lower bar-receiving holes in the lower portions of the right and left panels, respectively, wherein the inner panel is positioned between the upper and lower reinforcing bars.

* * * * *